US009158216B2

(12) United States Patent
Shimano et al.

(10) Patent No.: US 9,158,216 B2
(45) Date of Patent: Oct. 13, 2015

(54) METHOD FOR PRODUCING TONER PARTICLES

(71) Applicant: CANON KABUSHIKI KAISHA, Tokyo (JP)

(72) Inventors: Tsutomu Shimano, Mishima (JP); Masatake Tanaka, Yokohama (JP); Naoya Isono, Suntou-gun (JP); Shintaro Noji, Mishima (JP); Yu Yoshida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/242,792

(22) Filed: Apr. 1, 2014

(65) Prior Publication Data

US 2014/0302437 A1 Oct. 9, 2014

(30) Foreign Application Priority Data

Apr. 3, 2013 (JP) ..... 2013-078043

(51) Int. Cl.
*G03G 9/08* (2006.01)
*G03G 9/087* (2006.01)

(52) U.S. Cl.
CPC ..... *G03G 9/0806* (2013.01); *G03G 9/08711* (2013.01); *G03G 9/08755* (2013.01); *G03G 9/08788* (2013.01); *G03G 9/08795* (2013.01); *G03G 9/08797* (2013.01)

(58) Field of Classification Search
CPC ..... G03G 9/0804; G03G 9/08755; G03G 9/0806; G03G 9/08711; G03G 9/08793
See application file for complete search history.

(56) References Cited

U.S. PATENT DOCUMENTS 8,440,382 B2 5/2013 Isono et al.

FOREIGN PATENT DOCUMENTS

| | | |
|---|---|---|
| JP | 2006-65015 A | 3/2006 |
| JP | 2009-128652 A | 6/2009 |
| JP | 2012-2833 A | 1/2012 |

OTHER PUBLICATIONS

Saburo Akiyama, "Polymer Blends", CMC Press, First edition, 1981, p. 172.
"Glossary of Basic Terminology in Polymer Science by the Polymer Nomenclature Committee", Society of Polymer Science, International Union of Pure and Applied Chemistry, item 1.26, 1996.

*Primary Examiner* — Hoa V Le
(74) *Attorney, Agent, or Firm* — Fitzpatrick, Cella, Harper and Scinto

(57) ABSTRACT

A method for producing toner particles that contain a binder resin having a styrene-acrylic resin as a main component, a colorant, and a block polymer that has polyester segments and vinyl polymer segments, has a step of producing resin particles in accordance with a suspension polymerization method or a dissolution suspension method, and thereafter, holding the temperature of the aqueous medium in which the resin particles are dispersed, for 60 minutes or more, between a glass transition point TgA (° C.) of the resin particles and an onset temperature TmA (° C.) of an endothermic peak derived from the block polymer in the resin particles, in such a manner that a temperature fluctuation rate not greater than 0.35° C./minute, and a temperature fluctuation range is not greater than 20° C.

5 Claims, 9 Drawing Sheets

METHOD FOR PRODUCING TONER PARTICLES

BACKGROUND OF THE INVENTION

1. Field of the Invention

The present invention relates to a method for producing toner particles that are used in order to form toner images through development of an electrostatic latent image that is formed in accordance with a method such as an electrophotographic method, an electrostatic recording method or a toner jet recording method.

2. Description of the Related Art

A requirement of lower power consumption has been placed in recent years on printers and copying machines, while toner is required to exhibit ever better performance. Printers and copying machines must also be amenable to use, without problems, under various environments, and toner is required to have improved heat-resistant storability, and, at the same time, exhibit no changes in performance on account of storage.

To meet these both requirements it becomes necessary to solve the trade-off inherent in suppressing changes in physical properties during high-temperature storage while permitting softening of the toner.

To that end, toners have been studied in which a crystalline resin having excellent response speed to heat is added to the toner. However, simple addition of a crystalline resin entails not only instances of worsened heat-resistant storability of the toner, but also instances where the degree of crystallinity of the crystalline resin changes on account of high-temperature storage, and the performance of toner is impaired as a result. Accordingly, toners have been proposed in which various approaches are resorted to with a view to bringing out the characteristics of the crystalline resin. One such approach involves specifically leaving the crystalline resin for a prolonged period of time at a temperature lower than the melting point of the crystalline resin, to elicit as a result growth of crystals in the crystalline resin, enhance heat-resistant storability, and suppress changes in degree of crystallinity derived from high-temperature exposure.

Japanese Patent Application Publication No. 2006-065015 proposes a toner production method comprising a step of storing a toner that contains a crystalline resin, at a temperature ranging from 45° C. to 65° C. In the above toner production method, however, part of the toner may aggregate as a result of the step of storing the toner at that temperature. Since the above step is carried out in accordance with a dry scheme, the method was also problematic owing to concerns regarding image density, and otherwise poorer developing performance of the toner, on account of the occurrence of the phenomenon whereby the crystalline resin that is present in the vicinity of the toner surface migrates into the toner surface accompanying crystal grow.

Japanese Patent Application Publication No. 2009-128652 proposes a toner wherein a crystalline polyester is added to a non-crystalline polyester, and a thermal treatment is carried out at a specific temperature that is lower than the melting point of the crystalline polyester. In the above toner, the non-crystalline polyester is used in a binder resin, and hence the crystalline polyester is compatibilized with the binder resin in the production process of the toner. As a result, not only did the improvement efficiency of degree of crystallinity in a subsequent heating treatment drop very significantly, but also instances arose wherein some of the components remained compatibilized, and sufficient heat-resistant storability failed to be obtained.

Japanese Patent Application Publication No. 2012-2833 proposes a toner production method comprising a step of holding a suspension-polymerized toner that contains a crystalline resin at a temperature that is lower than the melting point of the crystalline resin, during a production process. In the above toner, the binder resin and the crystalline resin constitute a non-compatible system. In some instances, therefore, the dispersion state of the crystalline resin in the toner did not readily become homogeneous, even if the degree of crystallinity was improved from that state, and sufficient low-temperature fixability and sufficient heat-resistant storability failed to be achieved concomitantly.

Such being the case, various approaches have been proposed in order to suppress adverse effects on the storability of toners into which a crystalline resin is introduced, while sufficiently bringing out the fixing performance that is elicited by adding a crystalline resin. However, no toner production method has been yet proposed in which sufficient performance is effectively achieved.

SUMMARY OF THE INVENTION

The present invention provides a toner production method that solves the above-described conventional problems. Specifically, the present invention provides a production method whereby a toner is obtained that can be fixed at low energy, has sufficient heat-resistant storability, and exhibits little changes in performance on account of storage at high temperature.

The present invention relates to a method for producing toner particles, the method comprising:

a process (A) of obtaining resin particles in accordance with method i) or ii) below i) adding, to an aqueous medium, a polymerizable monomer composition that contains a polymerizable monomer, a colorant and a block polymer, obtaining a granulated particles by performing granulation of the polymerizable monomer composition, and polymerizing the polymerizable monomer contained in the granulated particles, to thereby produce resin particles;

ii) preparing a resin solution by dissolving or dispersing a binder resin, a colorant and a block polymer in an organic solvent, adding the resin solution to an aqueous medium, performing granulation of the resin solution, and removing the organic solvent contained in the granulated particles, to thereby produce resin particles; and a process (B) of holding the temperature of the aqueous medium in which the resin particles obtained in the process (A) are dispersed, for 60 minutes or more, between a glass transition point TgA (° C.) of the resin particles and an onset temperature TmA (° C.) of an endothermic peak derived from the block polymer in the resin particles, in such a manner that a temperature fluctuation rate is not greater than 0.35° C./minute, and a temperature fluctuation range is not greater than 20° C., wherein each of the toner particles contains:

a) a binder resin having a styrene-acrylic resin as a main component;

b) a colorant; and c) a block polymer; and the block polymer contains polyester segments and vinyl polymer segments, and has an endothermic peak in a measurement using a differential scanning calorimeter.

Further features of the present invention will become apparent from the following description of exemplary embodiments (with reference to the attached drawings).

DESCRIPTION OF THE EMBODIMENTS

The inventors conducted extensive studies on a re-assessment of the molecular design of crystalline resins and binder resins in a process (hereafter also referred to as annealing process) of enhancing the degree of crystallinity of a crystalline resin. As a result, the inventors found that singular phenomena are observed, and the effect elicited by the annealing process is dramatically enhanced, in a case where there are used a binder resin having a styrene-acrylic resin as a main component, and a block polymer, having vinyl polymer segments and polyester segments, as a crystalline resin having an endothermic peak in a measurement using a differential scanning calorimeter.

In the toner production method of the present invention, the process (B) below is an annealing process.

Process (B):

holding the temperature of the aqueous medium in which the resin particles obtained in the process (A) are dispersed, for 60 minutes or more, between a glass transition point TgA (° C.) of the resin particles, and an onset temperature TmA (° C.) of an endothermic peak derived from the block polymer in the resin particles, in such a manner that a temperature fluctuation rate is not greater than 0.35° C./minute, and a temperature fluctuation range of the temperature of the aqueous medium is not greater than 20° C.

Figure 2:
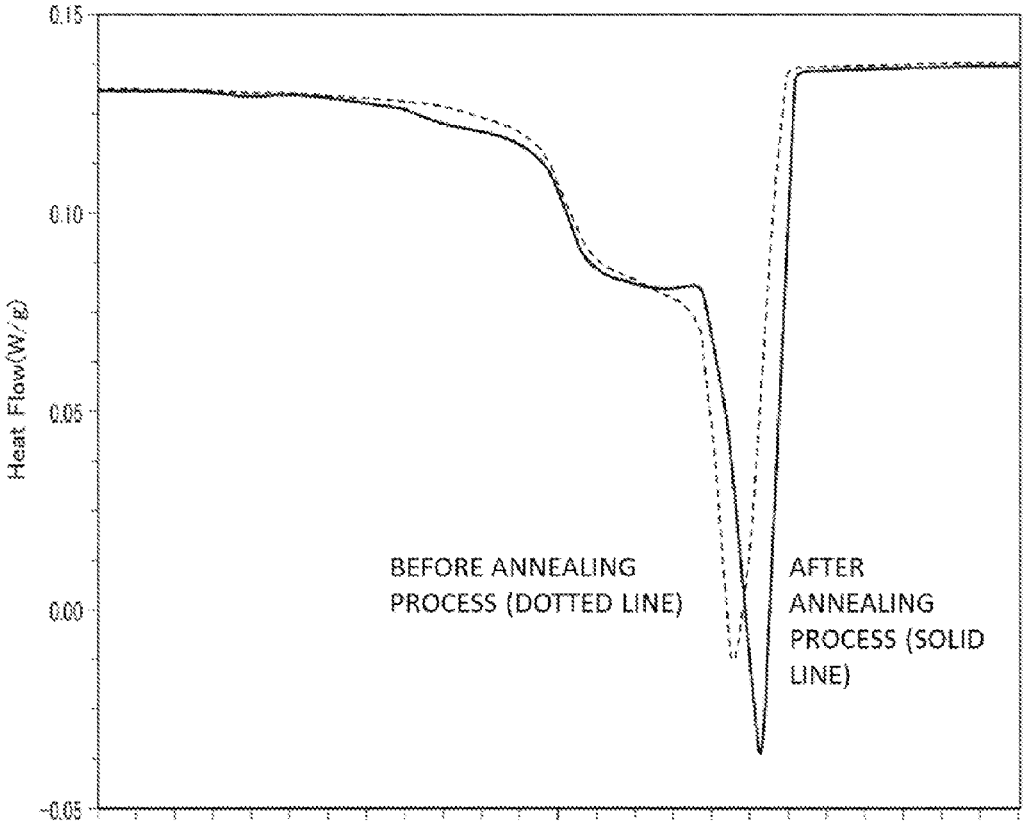
FIG. 2 is a diagram illustrating the change in endothermic characteristic before and after an annealing process, in a conventional example.

FIG. 2 illustrates the change in endothermic characteristics before and after an annealing process when using a styrene-acrylic binder resin and a crystalline polyester, as a conventional combination. Simply, the heat absorption amount at the endothermic peak derived from the crystalline polyester increase slightly, which indicates that the degree of crystallinity of the crystalline resin is enhanced.

Figure 3:
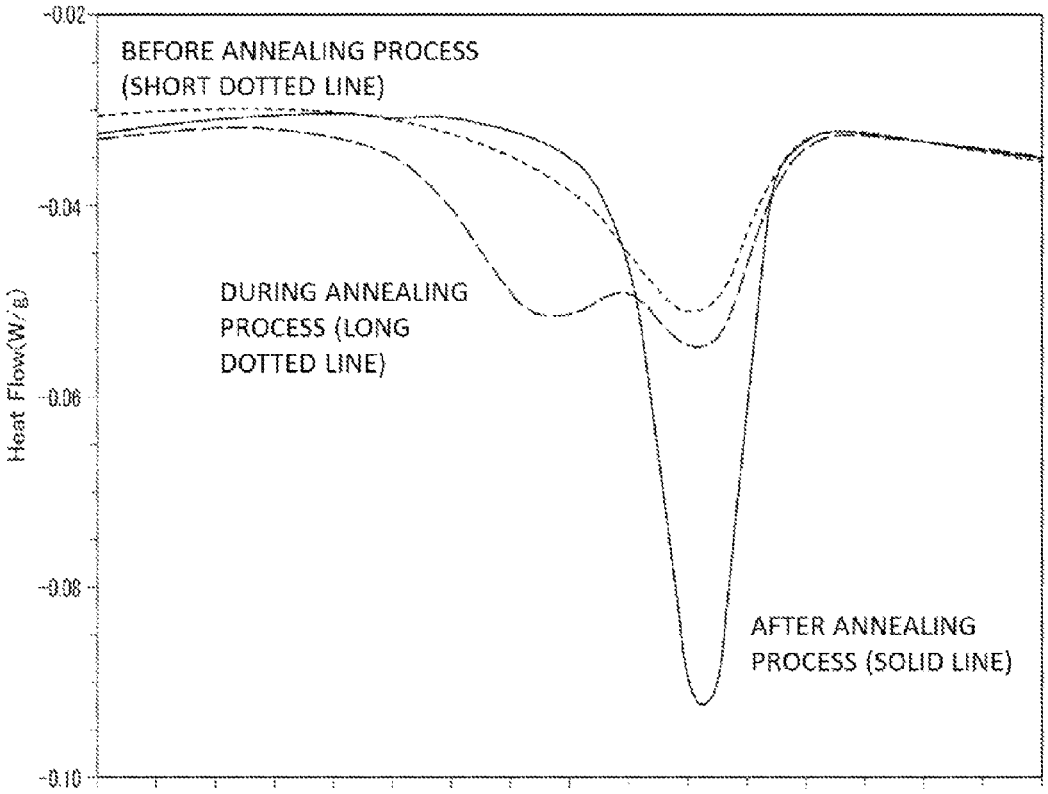
FIG. 3 is a diagram illustrating the change in endothermic characteristic before and after an annealing process, in the present invention.

FIG. 3 illustrates the change in endothermic characteristic before and after the annealing process in a case where there are used binder resin and a block polymer having vinyl polymer segments and polyester segments, as the crystalline resin having an endothermic peak in a measurement using a differential scanning calorimeter, of the present invention. An endothermic peak arises anew at a temperature different from that of the endothermic peak derived from the crystalline resin, and a behavior is observed whereby, as the annealing process progresses, the peak fuses with the original endothermic peak derived from the crystalline resin. The change in heat absorption amount became thus very large. When using a binder resin and a block polymer having vinyl polymer segments and polyester segments and having an endothermic peak in a measurement using a differential scanning calorimeter, thus, it is deemed that the effect elicited by the annealing process is significantly enhanced, in the present invention, on account of a phenomenon different from conventional ones.

Figure 4:
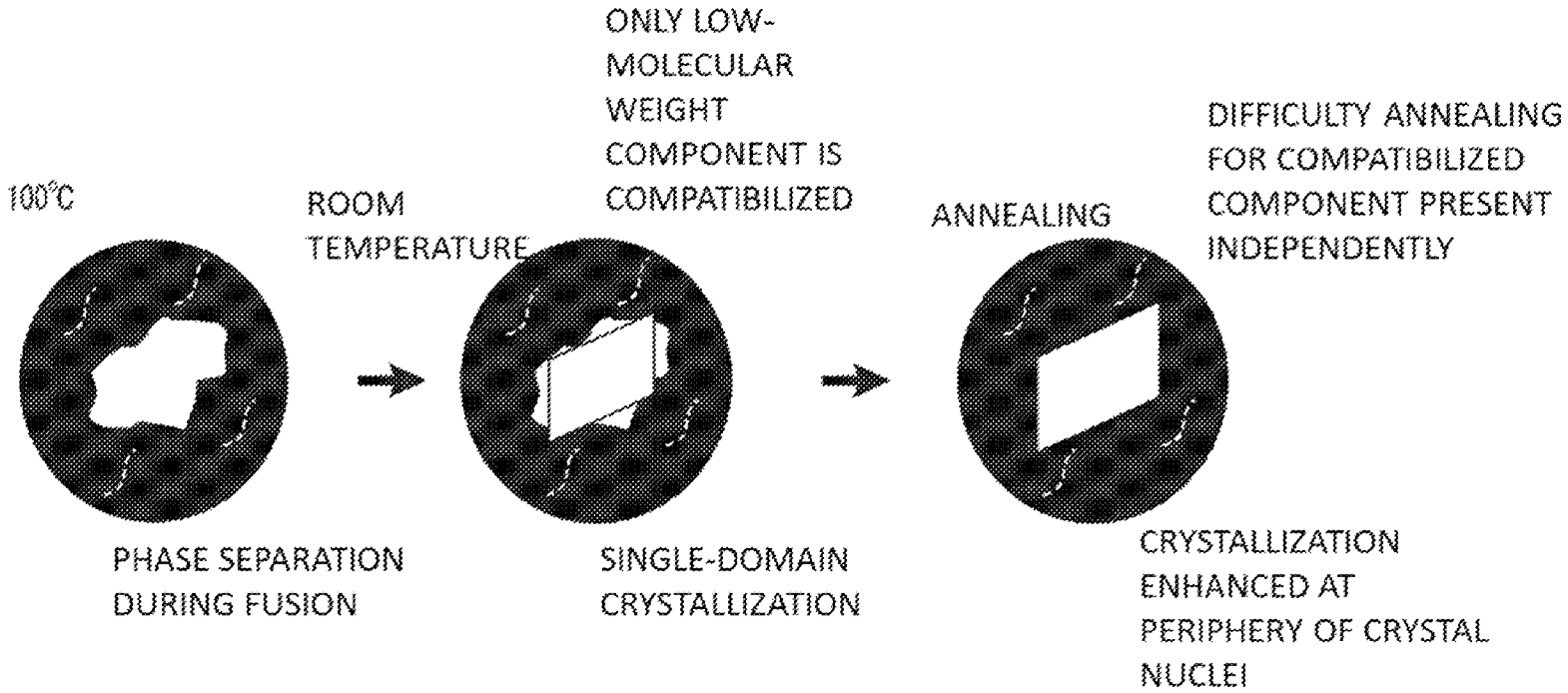
FIG. 4 is a diagram illustrating schematically the formation of domain structures of a block polymer as a result of an annealing process, in a conventional example.

The phenomenon involved is not wholly clear, but is deemed to arise from the state in which the crystalline resin is present in toner. An example of an instance where a crystalline polyester is used as the crystalline resin will be explained next. Herein, crystalline polyester is often present, in the toner, in the form of domains that are wholly phase-separated from the binder resin, as illustrated in FIG. 4. Part of the crystalline polyester, however, is compatible with the binder resin, and thus the glass transition temperature of the binder resin is lowered. This can be confirmed based on analysis of measurement data of the glass transition temperature of the toner. When an annealing process is carried out, crystal growth is presumed to occur, ordinarily, mainly around the domains of the crystalline resin that is originally present. The component that is compatible with the binder resin is deemed to undergo crystallization by merging into the originally present domains, and it is found that crystallization of components that are compatible with the binder resin requires thus a significantly long time.

Figure 1:
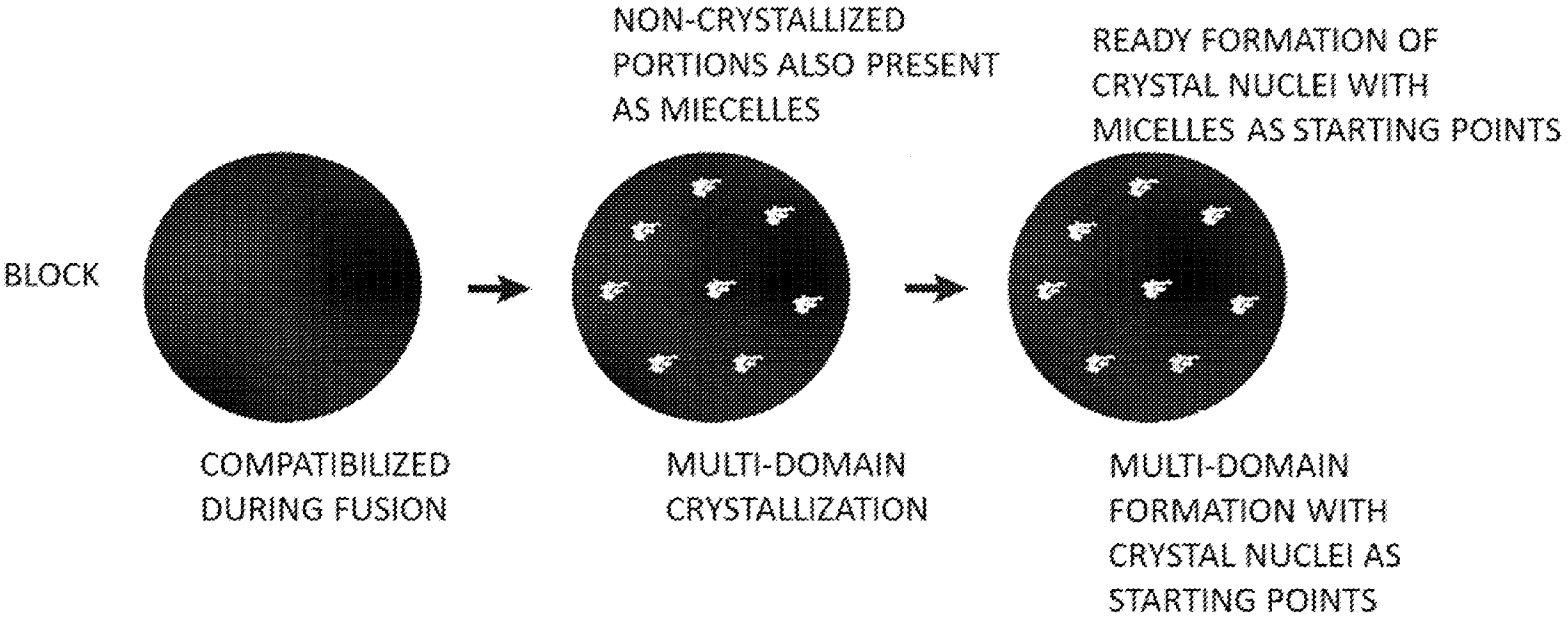
FIG. 1 is a diagram illustrating schematically the formation of domain structures of a block polymer as a result of an annealing process, in the present invention.

By contrast, a state is often observed wherein the crystalline resin is finely dispersed in the binder resin, in a case where a block polymer having vinyl polymer segments and polyester segments is used as the crystalline resin having an endothermic peak in a measurement using a differential scanning calorimeter. This may be ascribed to the formation of a micellar fine dispersion state in which the polyester segments are surrounded by the vinyl polymer segments, as illustrated in FIG. 1 (reference document: "Polymer Blends", Saburo AKIYAMA, CMC Press, Dec. 8, 1981, First edition, p. 172).

The component that is compatibilized into the binder resin is surmised to be in a micellar state. It is deemed that if the annealing process is carried out from this state, crystal nuclei form quickly, with the formed micelles acting as starting points, and that an endothermic peak arises, as a result of nucleation process, at a temperature different from that of the endothermic peak of the original crystalline resin.

The crystal nuclei grow as the annealing process is continued, and, as a result, the endothermic peak rises to a temperature comparable to that of the original crystalline resin. It is found that in this process, the crystal growth efficiency is dramatically enhanced through formation the crystal nuclei, which is deemed to be accordingly associated with the above-described significant increase in heat absorption amount.

The inventors discovered thus a singular phenomenon, in an annealing process, in toner particles that utilize a binder resin having a styrene-acrylic resin as a main component, and a block polymer having vinyl polymer segments and polyester segments, and having an endothermic peak in a measurement using a differential scanning calorimeter, and arrived at the present invention on the basis of that finding.

The ordinary definition of a block polymer, and the one that will be adopted in the present invention, is that of a polymer made up of a plurality of linearly linked blocks (Society of Polymer Science, Glossary of Basic Terminology in Polymer Science by the Polymer Nomenclature Committee, International Union of Pure and Applied Chemistry).

The feature "having a styrene-acrylic resin as a main component" denotes that 50 mass % or more of a binder resin is a styrene-acrylic resin. Other binder resins that are used in conventionally known toners can be used in the present invention, so long as the effect of the present invention is not impaired thereby.

The block polymer of the present invention has polyester segments and vinyl polymer segments, and has an endothermic peak in a measurement using a differential scanning calorimeter. Any of the polyester segments and the vinyl polymer segments that make up the block polymer may be crystalline segments, but, preferably, the polyester segments are crystalline segments and the vinyl polymer segments are non-crystalline segments, from the viewpoint of solubility in the binder resin.

As the structural units of the vinyl polymer segments there can be used, for instance, known vinyl monomers such as styrene, methacrylic acid esters (for instance, methyl methacrylate), and acrylic acid esters (for instance, n-butylacrylate). More preferably, styrene is used as the main structural unit of the vinyl polymer, in terms of compatibility with the binder resin having a styrene-acrylic resin as a main component, and from the viewpoint of formation of a phase separation structure.

The present invention involves producing resin particles in accordance with the above-described suspension polymerization method or dissolution suspension method, and thereafter, holding, for 60 minutes or more, a state where the temperature of the aqueous medium, with the resin particles dispersed therein, exhibits a temperature fluctuation rate no greater than 0.35° C./minute, in such a manner that a temperature fluctuation range of the temperature of the aqueous medium is no greater than 20° C., within a temperature range from a glass transition point TgA (° C.) of the resin particles up to an onset temperature TmA (° C.) of an endothermic peak derived from the block polymer in the resin particles.

Herein, whether the production of the resin particles is over or not is determined on the basis of polymerization conversion (mass %) of the resin particles or a solvent removal rate (mass %). In the present invention, the production of the resin particles is deemed to be over by the point in time at which the polymerization conversion or the solvent removal rate reaches 99.0% or higher; the annealing process can be carried out thereupon using the resin particles.

The resin particles are produced in accordance with a suspension polymerization method or dissolution suspension method, as a result of which a state can be brought about wherein the block polymer is dispersed, in a micellar fashion, in the binder resin. The above-described effects of the present invention can be achieved as a result.

The effect of the annealing process is elicited by virtue of the fact that the temperature of the aqueous medium in the annealing process ranges from TgA (° C.) to TmA (° C.), and, as a result, the molecular motion of the block polymer is not readily constrained by the binder resin, and the block polymer undergoes recrystallization.

The temperature fluctuation rate of the aqueous medium in the annealing process is not greater than 0.35° C./minute; as a result, crystal nuclei of the block polymer are effectively formed, and crystal growth can be carried out effectively while causing the domains of the block polymer to be finely dispersed.

The holding time is 60 minutes or more. An enhancing effect of heat resistance accompanying crystallization of the block polymer is achieved as a result. The upper limit of the holding time is not particularly prescribed, and may be established in consideration of production efficiency, given that the effect that is obtained exhibits no significant changes for a holding time of 1200 minutes or more.

The temperature fluctuation range of the aqueous medium in the annealing process is not greater than 20° C.; thereby, formation of crystal nuclei in the block polymer and crystal growth take place at sufficient rates, as a result of which the block polymer can be brought to a state of fine dispersion and high degree of crystallinity.

Thanks to the above controlled features, it becomes possible to combine excellent low-temperature fixability (low-energy fixing) with excellent heat-resistant storability, and to produce a toner that exhibits little changes in fixing performance and developing performance, even after high-temperature storage.

Regarding the above holding time, the annealing process may be carried out in such a manner that the total time thereof lies within the above range, or may be divided into several annealing processes. Preferably, the holding time is 120 minutes or more. If the annealing process is divided into several annealing processes, then the temperature of the aqueous medium having the resin particles dispersed therein must be controlled, between annealing processes, in such a manner so as not to become higher than TmA (° C.).

The temperature fluctuation rate may be modified during the annealing process, so long as it is no greater than 0.35° C./minute. Preferably, the temperature fluctuation rate is no greater than 0.20° C./minute. The temperature fluctuation rate is given herein by the maximum value of the value resulting from dividing the temperature fluctuation (° C.) of the aqueous medium in the annealing process by the time (minutes) required for that fluctuation in temperature. If the temperature varies several times during the annealing process of the present invention, it suffices that the temperature fluctuation rate calculated at each fluctuation of temperature satisfies the above range. The temperature fluctuation rate is calculated on the basis of the change in temperature per unit time of five minutes or more. Preferably, the temperature fluctuation range in the annealing process as a whole is the difference between the highest temperature and the lowest temperature of the aqueous medium during the annealing process, and is no greater than 15° C. If the temperature varies several times during the annealing process in the present invention, it suffices that the temperature fluctuation range at each fluctuation of temperature satisfies the above range.

In the annealing process of the present invention, preferably, the temperature of the aqueous medium, in a state where resin particles are dispersed in the aqueous medium, is set to a temperature range from the glass transition point TgA (° C.) of the resin particles up to the temperature TcA (° C.) at which generation of heat associated with cold crystallization of the block polymer is over. The temperature of the aqueous medium is not higher than TcA (° C.); as a result, it becomes possible to further increase the crystal growth rate of the block polymer, and to sufficiently crystallize a low-melting point component, such as a low-molecular weight component. The effect elicited by annealing can be made more pronounced as a result, and better heat resistance and developing performance can be accordingly achieved in turn. The temperatures TgA (° C.), TmA (° C.) and TcA (° C.) can be controlled on the basis of the types and molecular weights of the monomers that make up the respective resins. The method for measuring TgA (° C.), TmA (° C.) and TcA (° C.) is explained further on.

The composition of the polyester segments that make up the block polymer of the present invention is not particularly limited, but preferably, as described above, the polyester segments are crystalline segments having an endothermic peak.

Preferably, the polyester segments of the block polymer are crystalline segments made up of a dicarboxylic acid represented by Formula (1) below and a diol represented by Formula (2) below, from the viewpoint of combining low-temperature fixability and heat resistance, and in terms of annealing efficiency.

$$HOOC—(CH_2)_m—COOH \quad \text{Formula (1)}$$

(in the formula, m represents an integer from 6 to 14), $$HO—(CH_2)_n—OH \quad \text{Formula (2)}$$

(in the formula, n represents an integer from 6 to 16),

By using the above constituent components, it becomes possible to achieve a finer dispersion of the block polymer in the toner particles, while increasing the crystal growth rate during annealing. Better low-temperature fixability can be achieved as a result, while preserving heat resistance.

More preferably, m ranges from 7 to 10. More preferably, n ranges from 6 to 12.

More preferably, a solubility parameter (SP) value of the polyester segments ranges from 9.40 to 9.85. By satisfying the above ranges, the compatibility of the binder resin and the block polymer at during fusion is enhanced, and a more pronounced low-temperature fixing effect is achieved.

In the present invention, preferably, the vinyl polymer segments of the block polymer are non-crystalline segments, and the glass transition point of the vinyl polymer segments TgB (° C.) is equal to or higher than TmA (° C.). Since TgB (° C.) is equal to or higher than TmA (° C.), the annealing process is accordingly carried out at or below the glass transition point TgB (° C.) of the vinyl polymer segments. As a result, the degree of crystallinity can be enhanced while motion and re-arrangement of the domains of the block polymer that is finely dispersed in the resin particles is curtailed by the vinyl polymer segments. As a result, better heat-resistant storability can be achieved while preserving low-temperature fixability.

The TgB (° C.) of the vinyl polymer segments can be controlled based on the type of the monomers that make up the vinyl polymer segments, and based on the molecular weight of the vinyl polymer segments.

The mass ratio of the polyester segments and the vinyl polymer segments in the block polymer ranges preferably from 30:70 to 70:30, and more preferably from 40:60 to 70:30. By virtue of the above ranges, it becomes possible to concurrently achieve fusing characteristics, as a crystalline resin, while bringing the dispersion state of the block polymer in the resin particles to a finely dispersed state. As a result, the effect of the annealing process can be achieved yet more effectively while securing better low-temperature fixability. The ratio of polyester segments and vinyl polymer segments in the block polymer can be controlled based on, for instance, production conditions, such as temperature and synthesis time during production of the block polymer, and based on the charge ratio of the monomers. The method for analyzing the ratio of the polyester segments and vinyl polymer segments in the block polymer is explained further on.

Preferably, the temperature Tmp (° C.) at the apex of the endothermic peak of the block polymer ranges from 55° C. to 100° C. Herein, Tmp (° C.) of the block polymer lies in the above range, as a result of which it becomes possible to suppress drops in heat resistance while bringing out low-temperature fixability elicited through addition of the block polymer. More preferably, Tmp (° C.) ranges from 60° C. to 90° C.

The heat absorption amount of the block polymer ranges preferably from 20 J/g to 120 J/g, more preferably from 30 J/g to 90 J/g, from the viewpoint of maintaining crystallinity during incorporation of the block polymer into the toner particles, and from the viewpoint of crystal growth rate in the annealing process. By virtue of the above ranges, portions in which crystallinity is maintained are present also during incorporation of the block polymer into the toner particles, and as a result crystal growth takes place quickly, with these portions as starting points, during the annealing process.

Herein, Tmp (° C.) and the heat absorption amount can be controlled based on the molecular weight and the type of the monomers that make up the polyester segments in the block polymer. The methods for measuring Tmp (° C.) and the heat absorption amount are described further on.

Preferably, the weight-average molecular weight (Mw) of the block polymer ranges from 20000 to 45000. The block polymer that becomes compatibilized into the binder resin undergoes recrystallization faster in the annealing process by virtue of Mw being equal to or greater than 20000. Further, the melt viscosity of the block polymer can be made appropriate for low-temperature fixability by virtue of Mw being equal to or smaller than 45000. More preferably, the weight-average molecular weight (Mw) of the block polymer ranges from 23000 to 40000. The weight-average molecular weight (Mw) of the block polymer can be controlled based on the synthesis temperature and synthesis time during production of the block polymer. The method for measuring the weight-average molecular weight (Mw) of the block polymer will be explained further on.

The method that can be resorted in the present invention for preparing the block polymer may be, for instance, a method that involves preparing separately the polyester segments and the vinyl polymer segments, and then joining the segments, or a method that involves preparing the polyester segments, charging then vinyl monomers, which are the starting material of the vinyl polymer segments, into the polyester segments, and conducting thereupon a polymerization reaction.

In the present invention, the content of the block polymer ranges preferably from 10 mass parts to 100 mass parts, more preferably 10 mass parts to 70 mass parts, with respect to 100 mass parts of the binder resin.

The method for producing toner particles of the present invention will be explained next in concrete terms by illustrating the procedure involved and the materials that can be used therein, but the method is not limited to the features set forth below.

Resin particles are produced in accordance with a suspension polymerization method or a dissolution suspension method, and thereafter, the resin particles are subjected to an annealing process in an aqueous medium, to produce as a result the toner particles of the present invention.

A specific production method of the resin particles according to a suspension polymerization method will be explained first.

The polymerizable monomers that form the binder resin of the toner particles, plus a colorant and a block polymer are added, and a polymerizable monomer composition is prepared by causing the other components to melt, dissolve or disperse into the polymerizable monomers, using a disperser such as a homogenizer, a ball mill, a colloid mill or an ultrasonic disperser. At this stage, a release agent, a polar resin, multifunctional monomers, a pigment dispersant, a charge control agent, a solvent for viscosity adjustment, as well as other additives (for instance, chain transfer agents), can be appropriately added, as needed, to the above polymerizable monomer composition.

Next, the polymerizable monomer composition is added to an aqueous medium, prepared beforehand, that contains a dispersion stabilizer, and granulation is performed then using a high-speed stirrer or a high-speed disperser such as an ultrasonic disperser.

A polymerization initiator may be mixed in, together with the other additives, during preparation of the polymerizable monomer composition, or may be mixed into the polymerizable monomer composition immediately before suspension in the aqueous medium. The polymerization initiator can be added during granulation, or after granulation is over, i.e. immediately before the start of the polymerization reaction, in a state of being dissolved in the polymerizable monomers or another solvent, as the case may require.

To polymerize the polymerizable monomers contained in the granulated particles, the resulting suspension is heated, under stirring, in such a manner that the particles of the polymerizable monomer composition in the suspension are maintained in a particle state and do not sediment or float up. An aqueous medium dispersion of resin particles is formed by performing a residual polymerizable monomer removal process and/or solvent removal process, as the case may require, once polymerization is completed.

A specific production method of the resin particles according to a dissolution suspension method will be explained next.

A binder resin, a colorant and a block polymer are added to an organic solvent, and the foregoing are homogeneously dissolved or dispersed using a disperser such as a homogenizer, a ball mill, a colloid mill or an ultrasonic disperser, to prepare a resin solution. A wax, as a release agent, a charge control agent, as well as further additives such as a dispersants, can be appropriately added at this stage, as needed, to the resin solution.

Next, the above resin solution is added to an aqueous medium, prepared beforehand, that contains the dispersion stabilizer, and the droplets of the dissolved resin are granulated using a high-speed stirrer or a high-speed disperser such as an ultrasonic disperser.

To remove the organic solvent from the granulated particles, the temperature of the whole system is gradually raised, to evaporate off the organic solvent from the dissolved resin droplets. The organic solvent is removed thus from the dissolved resin droplets, to form an aqueous medium dispersion solution of the resin particles.

The aqueous medium dispersion solution containing the resin particles formed in accordance with the above method is then subjected to an annealing process according to the above-described conditions. The annealing process may be performed during the process of cooling the aqueous medium dispersion solution of the resin particles, or may be performed, once the aqueous medium dispersion solution of the resin particles has been cooled, by re-heating the aqueous medium dispersion solution. The dispersion stabilizer such as a surfactant or inorganic microparticles may be added, as the case may require, at this stage. Toner particles can be obtained thereafter by performing, as needed, washing, as well as drying and classifying in accordance with various methods.

Vinylic polymerizable monomers that can undergo radical polymerization can be used herein as the polymerizable monomers that make up the styrene-acrylic resin that constitutes that main component of the binder resin. Monofunctional polymerizable monomers or multifunctional polymerizable monomers can be used as the vinylic polymerizable monomers.

Examples of monofunctional polymerizable monomers include, for instance, styrene derivatives such as styrene, α-methylstyrene, β-methylstyrene, o-methylstyrene, m-methylstyrene, p-methylstyrene, 2,4-dimethylstyrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene and the like;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, 2-benzoyloxyethyl acrylate and the like;

methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, dibutyl phosphate ethyl methacrylate and the like;

and examples of multifunctional polymerizable monomers include, for instance, diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis (4-(acryloxydiethoxy)phenyl) propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy diethoxy) phenyl)propane, 2,2'-bis(4-(methacryloxypolyethoxy) phenyl)propane, trimethylolpropane trimethacrylate, tetramethylolmethane tetramethacrylate, divinyl benzene, divinyl naphthalene, as well as divinyl ether.

Herein there can be used a monofunctional polymerizable monomer alone, or a combination of two or more types, or a combination of a monofunctional polymerizable monomer and a multifunctional polymerizable monomer, or a multifunctional polymerizable monomer alone, or a combination of two or more types.

The SP value of the styrene-acrylic resin ranges preferably from 9.45 to 9.90, more preferably from 9.50 to 9.85. Within that range, it becomes possible to easily strike a balance between the phase separation state when in the form of toner and compatibilized state during fusion, and to carry out annealing yet more effectively; a toner can thus be obtained that has better low-temperature fixability.

In the present invention, the toner particles contain a colorant. Known colorants, for instance conventionally known dyes and pigments, can be used herein as the colorant.

As a black colorant there can be used carbon black, a magnetic material, or a black colorant tinted to a black tone through the use of the below-described yellow, magenta and cyan colorants. For instance, the below-described colorants can be used as colorants for cyan toner, magenta toner and yellow toner.

Pigment-based yellow colorants that are used include compounds typified by monoazo compounds, disazo compounds, condensed azo compounds, isoindolinone compounds, anthraquinone compounds, azo metal complex methine compounds and allyl amide compounds. Specific examples thereof include C. I. Pigment Yellows 74, 93, 95, 109, 111, 128, 155, 174, 180, 185 and the like.

As the magenta colorant there are used monoazo compounds, condensed azo compounds, diketopyrrolopyrrole compounds, anthraquinone, quinacridone compounds, basic dye lake compounds, naphthol compounds, benzimidazolone compounds, thioindigo compounds and perylene compounds. Specific examples thereof include, for instance, C. I. Pigment Reds 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C. I. Pigment violet 19 and the like.

As the cyan colorant there can be used copper phthalocyanine compounds and derivatives thereof, anthraquinone compounds, and basic dye lake compounds. Specific examples thereof include, for instance, C. I. Pigment Blues 1, 7, 15, 15:1, 15:2, 15:3, 15:4, 60, 62, 66 and the like.

These colorants can be used alone or mixed with each other, and can be used in a solid solution state. In a case where the below-described magnetic material is used as a black colorant, the addition amount thereof ranges preferably from 40 mass parts to 150 mass parts with respect to 100 mass parts of the binder resin. In a case where carbon black is used as the black colorant, the addition amount thereof ranges preferably from 1 mass part to 20 mass parts with respect to 100 mass parts of the binder resin. In the case of color toner applications, the colorant is selected from the viewpoint of hue angle, chroma, lightness, weather resistance, OHP transparency and dispersibility in the toner particles; the preferred addition amount of the colorant ranges from 1 mass part to 20 mass parts with respect to 100 mass parts of a binder resin.

If magnetic toner particles are to be used as the toner particles in the present invention, it suffices to incorporate a magnetic material into the toner particles. In this case the magnetic material can serve also as a colorant. Examples of the magnetic material in the present invention include, for instance, iron oxides such as magnetite, hematite, ferrite or the like; metals such as iron, cobalt, nickel and the like, and alloys and mixtures of the foregoing with metals such as aluminum, cobalt, copper, lead, magnesium, tin, zinc, antimony, beryllium, bismuth, cadmium, calcium, manganese, selenium, titanium, tungsten and vanadium.

Release agents that can be used, as needed, in the present invention, are not particularly limited, and known release agents can be used. Specific examples thereof include, for instance, the following. Aliphatic hydrocarbon waxes such as low molecular weight polyethylene, low molecular weight polypropylene, microcrystalline wax, paraffin wax and Fischer-Tropsch wax; oxides of an aliphatic hydrocarbon wax, such as polyethylene oxide wax or block copolymers thereof; waxes having, as a main component, a fatty acid ester, for instance carnauba wax, Sasol wax, ester wax or montanic ester wax; waxes obtained through partial or complete de-oxidation of a fatty acid ester, for instance de-oxidized carnauba wax; waxes resulting from grafting of an aliphatic hydrocarbon wax with a vinylic monomer such as styrene or acrylic acid; partially esterified products of a polyhydric alcohol and a fatty acid, for instance behenic acid monoglyceride; or methyl ester compounds having a hydroxyl group, obtained for instance by hydrogenation of a vegetal oil.

The toner particles of the present invention may contain a charge control agent. Among the foregoing there are preferably used charge control agents that control toner particles so as to exhibit negative charging ability. Examples of charge control agents include, for instance, the following.

Organometallic compounds, chelate compounds, monoazo metal compounds, acetylacetone metal compounds, urea derivatives, metal-containing salicylic acid compounds, metal-containing naphthoic acid compounds, quaternary ammonium salts, calixarene, silicon compounds, as well as non-metal carboxylic acid compounds and derivatives thereof. Herein, sulfonic acid-based resins having a sulfonic acid group, a sulfonic salt group, or a sulfonic ester group can also be preferably used.

Known surfactants, organic dispersants and inorganic dispersant can be used as the dispersion stabilizer that is added to the aqueous medium. Inorganic dispersants can be suitably used among the foregoing, in that they are unlikely to give rise to ultrafine powders of toner particles, and the stability of the inorganic dispersants does not collapse readily even at the polymerization temperature or on account of elapsed time, and in that the dispersants can be cleaned easily, and do not readily affect negatively the toner. Examples of the inorganic dispersants include, for instance, the following. Polyvalent metal salts of phosphoric acid such as tricalcium phosphate, magnesium phosphate, aluminum phosphate and zinc phosphate; inorganic salts such as carbonates, for instance, calcium carbonate and magnesium carbonate, or calcium metasilicate, calcium sulfate and barium sulfate; and inorganic oxides such as calcium hydroxide, magnesium hydroxide, aluminum hydroxide, silica, bentonite and alumina. These inorganic dispersants can be removed substantially completely by being dissolved through addition of an acid or alkali after polymerization is over.

The methods for measuring the various physical property values specified in the present invention are described below.

<Method for Measuring TgA, TmA, TcA, Tmp, TgB and the Glass Transition Point of Toner Particles>

A differential scanning calorimeter "Q1000" (by TA Instruments) is used to measure TgA, TmA, TcA, Tmp, TgB and the glass transition point of toner particles, in accordance with ASTM D3418-82.

The melting points of indium and zinc are used for temperature correction in the detector of the device, and the heat of fusion of indium is used for heat amount correction.

Specifically, 2 mg of the measurement sample are weighed, the sample is placed in an aluminum pan, and modulation measurement is performed, using an empty aluminum pan as a reference, under settings of measurement range from 0° C. to 120° C., ramp rate 1° C./min, amplitude of temperature width ±0.318° C./min. In the process of raising the temperature there are obtained changes in specific heat within the temperature range from 0° C. to 120° C.

The glass transition point TgA (° C.) of the resin particles and the glass transition point of the toner particles are herein the temperatures at the points of intersection of a curve of step-wise variation portions of glass transition with straight lines that are equidistant in the ordinate axis direction, from straight lines that extend from a respective base line, before and after the occurrence of changes in specific heat in a curve of reversible change of specific heat.

The onset temperature TmA (° C.) of the endothermic peak derived from the block polymer in the resin particles is herein the temperature at the intersection between a straight line resulting from prolonging the low-temperature baseline towards the high-temperature side, and a tangent drawn with respect to the endothermic peak curve, at a point of maximum gradient, on the low-temperature side, of the endothermic peak curve. The temperature at the apex of the endothermic peak is herein Tmp (° C.), and the heat absorption amount (J/g) is the heat absorption amount derived from the block polymer. The heat absorption amount is worked out computationally, on the basis of the surface area of the endothermic peak, by the analysis software of the device.

The Tmp of the toner particles is measured in the same way as above, but with the measurement sample changed to toner particles, such that the temperature at the apex of the endothermic peak is taken as Tmp (° C.). The heat absorption amount (J/g) is worked out computationally, on the basis of the surface area of the endothermic peak, by the analysis software of the device.

The polyester segments of the block polymer are hydrolyzed to measure the endothermic characteristic of the vinyl polymer segments of the block polymer. The specific method involves adding 5 ml of dioxane and 1 ml of a 10 mass % aqueous solution of potassium hydroxide to 30 mg of the block polymer, and shaking the whole for 6 hours at a temperature of 70° C., to hydrolyze the polyester segments. Thereafter, the solution is dried, and the obtained solid fraction is dispersed and dissolved in ethanol. The lysate resulting from further filtering and washing is removed to yield vinyl polymer segments. The operations thereafter are identical to those in the measurement of other resin components.

The temperature TcA (° C.) at which generation of heat associated with cold crystallization of the block polymer is over is taken herein as the temperature at the intersection between a straight line resulting from prolonging, towards the high-temperature side, the low-temperature baseline of an exothermic peak upon measurement from a measurement temperature of 100° C. to 0° C., at a temperature lowering rate set to 1° C./min, and a tangent drawn with respect to the exothermic peak curve, at a point of maximum gradient of the exothermic peak curve, on the low-temperature side.

<Method for Measuring the Ratio of Polyester Segments and Vinyl Polymer Segments in the Block Polymer>

The ratio of polyester segments and vinyl polymer segments in the block polymer was measured by magnetic resonance spectroscopy ($^1$H-NMR) (400 MHz, CDCl3, room temperature (25° C.)).

Measurement device: FT NMR device JNM-EX400 (by JEOL)

Measurement frequency: 400 MHz

Pulse conditions: 5.0 μs

Frequency range: 10500 Hz

Number of integrations: 64

The mass ratio (C/A ratio) of polyester segments and vinyl polymer segments was calculated based on the integration value of the obtained spectrum.

<SP Value Calculation Method>

The SP value in the present invention was worked out using Expression (1) by Fedors. Herein, the values of Δei and Δvi were obtained by referring to the evaporation energy and the molar volume (25° C.) of atoms and atomic groups according to Tables 3 to 9 of "Kotingu no Kiso Kagaku (Basic Science of Coatings"), 1986 (Maki Shoten).

$$\delta i=[Ev/V]^{1/2}=[\Delta ei/\Delta vi]^{1/2} \quad \text{Expression (1)}$$

Ev: evaporation energy

V: molar volume

Δei: evaporation energy of atoms or atomic groups of component i

Δvi: molar volume of atoms or atomic groups of component i

For instance, hexanediol is made up of the atomic groups (—OH)×2+(—$CH_2$)×6, and hence the calculated SP value thereof is worked out as $$\delta i=[\Delta ei/\Delta vi]^{1/2}=[\{(5220)\times 2+(1180)\times 6\}/\{(13)\times 2+(16.1)\times 6\}]^{1/2}$$

and the SP value (δi) is 11.95.

<Method for Measuring the Weight-Average Molecular Weight (Mw) of the Various Resins>

The weight-average molecular weight (Mw) of the block polymer or the various resins is measured by gel permeation chromatography (GPC), as follows.

Firstly, the block polymer or the various resins are dissolved in tetrahydrofuran (THF) at room temperature. Each obtained solution is then filtered using a solvent-resistant membrane filter "MyShoriDisk" (by Tosoh Corporation), having a pore diameter of 0.2 μm, to yield a sample solution. Each sample solution is adjusted so that the concentration of components soluble in THF is 0.8 mass %. The sample solutions are measured under the following conditions.

Device: High-speed GPC device (HLC-8220GPC) (by Tosoh Corporation)

Column: LF-604×2 (by Showa Denko)

Eluent: THF

Flow rate: 0.6 ml/min

Oven temperature: 40° C.

Sample injection volume: 0.020 ml

A molecular weight calibration curve constructed using standard polystyrene resins (trade name "TSK Standard polystyrene F-850, F-450, F-288, F-128, F-80, F-40, F-20, F-10, F-4, F-2, F-1, A-5000, A-2500, A-1000, A-500", by Tosoh Corporation) is used to calculate molecular weight of the samples.

<Method for Measuring the Volume-Average Particle Diameter of the Microparticles>

The volume-average particle diameter (μm or nm) of microparticles is measured using a Microtrack particle diameter distribution measurement device HRA (X-100), by Nikkiso, with a particle diameter 0.001 to 10 μm set as the range setting.

<Method for Measuring the Polymerization Conversion and Solvent Removal Rate of the Resin Particles>

The polymerization conversion or solvent removal rate of the resin particles are measured by gas chromatography (GC), as follows.

About 500 mg of a resin particle dispersion solution is weighed and placed in a sample vial. About 10 g of weighed acetone are added to the vial, and the latter is capped; the whole is thoroughly mixed thereafter, and is irradiated, for 30 minutes, with ultrasounds, using a Tabletop ultrasonic cleaner (Trade name "B2510J-MTH", by Branson), at an oscillation frequency of 42 kHz and electrical output of 125 W. Thereafter, the mixture is filtered using a solvent-resistant membrane filter "MyShoriDisk" (by Tosoh Corporation), having a pore diameter of 0.2 μm, and 2 μL of the filtrate are analyzed by gas chromatography. The "residual amount" of the residual polymerizable monomers or solvent is calculated using a calibration curve prepared using polymerizable monomers or the solvent having been used beforehand. The polymerization conversion (mass %) and solvent removal rate (mass %) of the resin particles are defined according to the expressions below.

$$100\times(1-(\text{residual amount})/(\text{total amount of polymerizable monomer or solvent used})) \quad \text{(Expression)}$$

EXAMPLES

The present invention will be explained next based on examples, but the present invention is not limited to these examples. The "parts" recited in the examples denote mass parts in all cases.

<Production of Crystalline Polyester 1>

A reaction vessel equipped with a stirrer, a thermometer, a nitrogen inlet tube, a water-removal tube and a pressure-reducing device was charged with 100.0 parts of sebacic acid and 106.5 parts of 1,12-dodecanediol, with heating up to a temperature of 130° C. under stirring. Then 0.7 parts of titanium (IV) isopropoxide, as an esterification catalyst, were added, the temperature was raised to 160° C., whereupon condensation polymerization proceeded for 5 hours. Thereafter, the temperature was raised to 180° C., and the reaction was left to proceed under reduced pressure down to a desired molecular weight, to yield polyester (1). The weight-average molecular weight (Mw) of polyester (1) was 19000, and the melting point (Tm) was 84° C. The obtained polyester (1) is crystalline polyester 1.

<Production of Block Polymer 1>

A reaction vessel equipped with a stirrer, a thermometer and a nitrogen inlet tube was charged with 100.0 parts of polyester (1) and 440.0 parts of dehydrated chloroform, and dissolving completely; this was followed by addition of 5.0 parts of triethylamine, and gradual addition of 15.0 parts of 2-bromoisobutyryl bromide, under ice cooling. Thereafter, the whole was stirred overnight at room temperature (25° C.) to yield a resin solution.

The above resin solution was gradually dripped into a vessel charged with 550.0 parts of methanol, to re-precipitate the resin fraction. This was followed by filtering, purification and drying, to yield polyester (2).

Next, a reaction vessel equipped with a stirrer, a thermometer and a nitrogen inlet tube was charged with 100.0 parts of the obtained polyester (2), 155.0 parts of styrene, 3.5 parts of copper bromide (I), and 8.5 parts of pentamethyldiethylenetriamine, and a polymerization reaction was conducted at a temperature of 110° C. while under stirring. The reaction was stopped once the desired molecular weight was achieved, and the product was re-precipitated with 250.0 parts of methanol, was filtered and dried, and the unreacted styrene and the catalyst were removed. This was followed by drying in a vacuum dryer set to 50° C., to yield block polymer 1 having polyester segments and vinyl polymer segments.

<Production of Block Polymers 2 to 11>

Block polymers 2 to 11 were obtained in accordance with the same production method as that of block polymer 1, but modifying herein the starting materials as in Table 1.

TABLE 1

| | MONOMER COMPOSITION OF POLYESTER SEGMENTS | | | | MONOMER COMPOSITION OF VINYL POLYMER SEGMENTS | |
|---|---|---|---|---|---|---|
| | acid monomer | mass parts | alcohol monomer | mass parts | vinyl monomer | mass parts with respect to 100 parts of polyester segments |
| block polymer 1 | sebacic acid | 100.0 | 1,12-dodecanediol | 106.5 | styrene | 100.0 |
| block polymer 2 | sebacic acid | 100.0 | 1,9-nonanediol | 83.0 | styrene | 100.0 |
| block polymer 3 | sebacic acid | 100.0 | 1,6-hexanediol | 54.5 | styrene | 100.0 |
| block polymer 4 | dodecanedioic acid | 100.0 | 1,12-dodecanediol | 94.0 | styrene | 100.0 |
| block polymer 5 | dodecanedioic acid | 100.0 | 1,6-hexanediol | 54.5 | styrene | 100.0 |
| block polymer 6 | sebacic acid | 100.0 | 1,12-dodecanediol | 106.5 | styrene | 200.0 |
| block polymer 7 | sebacic acid | 100.0 | 1,12-dodecanediol | 106.5 | styrene: n-BA 80:20 | 100.0 |
| block polymer 8 | tetradecanedioic acid | 100.0 | 1,12-dodecanediol | 84.0 | styrene | 80.0 |
| block polymer 9 | sebacic acid | 100.0 | 1,12-dodecanediol | 106.5 | styrene | 200.0 |
| block polymer 10 | sebacic acid | 100.0 | 1,12-dodecanediol | 106.5 | styrene | 50.0 |
| block polymer 11 | sebacic acid | 100.0 | 1,12-dodecanediol | 106.5 | styrene | 200.0 |

In the table, n-BA denotes n-butylacrylate.

<Production of Crystalline Polyester 2>

A reaction vessel equipped with a stirrer, a thermometer, a nitrogen inlet tube, a water-removal tube and a pressure-reducing device was charged with 100.0 parts of sebacic acid and 106.5 parts of 1,12-dodecanediol, with heating up to a temperature of 130° C. under stirring. Then, 0.7 parts of titanium (IV) isopropoxide, as an esterification catalyst, were added, the temperature was raised to 160° C., whereupon condensation polymerization proceeded for 5 hours. Thereafter, the temperature was raised to 180° C., and the reaction was left to proceed under reduced pressure down to a desired molecular weight, to yield crystalline polyester 2. The weight-average molecular weight (Mw) of crystalline polyester 2 was 35000, and the melting point (Tm) was 84° C.

The physical properties of the obtained block polymers 1 to 11 and crystalline polyesters 1 and 2 are given in Table 2.

TABLE 2

| | Tmp (° C.) | heat absorption amount (J/g) | temperature at which cold crystallization-derived heat generation is over (TcA(° C.)) | weight-average molecular weight (Mw) | C/A ratio | glass transition point of vinyl polymer segments (TgB(° C.)) | SP value of polyester segments |
|---|---|---|---|---|---|---|---|
| Block polymer 1 | 80 | 61.1 | 65 | 33000 | 60:40 | 95 | 9.48 |
| Block polymer 2 | 69 | 34.3 | 48 | 33000 | 50:50 | 88 | 9.62 |
| Block polymer 3 | 61 | 37.9 | 41 | 33000 | 65:35 | 80 | 9.80 |
| Block polymer 4 | 85 | 78.9 | 69 | 34000 | 60:40 | 95 | 9.45 |
| Block polymer 5 | 71 | 54.2 | 45 | 32000 | 50:50 | 93 | 9.67 |
| Block polymer 6 | 80 | 69.5 | 65 | 27000 | 65:35 | 75 | 9.48 |
| Block polymer 7 | 80 | 54.2 | 65 | 32000 | 45:55 | 60 | 9.48 |
| Block polymer 8 | 93 | 84.3 | 67 | 28000 | 70:30 | 80 | 9.48 |
| Block polymer 9 | 74 | 41.8 | 65 | 37000 | 40:60 | 95 | 9.48 |
| Block polymer 10 | 80 | 89.3 | 68 | 24000 | 72:28 | 77 | 9.48 |
| Block polymer 11 | 72 | 37.0 | 62 | 40000 | 32:68 | 95 | 9.48 |
| Crystalline polyester 1 | 84 | 112.9 | 68 | 19000 | 100:0 | — | 9.48 |
| Crystalline polyester 2 | 84 | 102.9 | 67 | 35000 | 100:0 | — | 9.48 |

<Production of Resin Particle Dispersion Solution 1>

| | |
|---|---|
| Styrene | 49.0 parts |
| n-butylacrylate | 21.0 parts |
| Pigment blue 15:3 | 6.0 parts |
| Aluminum salicylate compound (BONTRON E-88: by Orient Chemical Industries) | 1.0 part |
| Polar resin (styrene - 2-hydroxyethyl methacrylate - methacrylic acid - methyl methacrylate copolymer (mass ratio 95:2:2:3), acid value = 10 mgKOH/g, glass transition point (Tg) = 80° C., weight-average molecular weight (Mw) = 15000) | 5.0 parts |
| Release agent: paraffin wax (HNP-9: by Nippon Seiro: melting point = 75° C.) | 7.0 parts |
| Block polymer 1 | 30.0 parts |

The above constituents were mixed, 15-mm ceramic beads were added into the resulting mixture, and the latter was dispersed for 2 hours using an attritor (by Mitsui Miike Machinery), to yield a polymerizable monomer composition.

A vessel equipped with a high-speed stirring device TK-homomixer (by Tokushu Kika Kogyo) was charged with 800 parts of deionized water and 15.5 parts of tricalcium phosphate, the rotational speed was adjusted to 15000 revolutions/minute, and the whole was warmed to 70° C. to yield an aqueous dispersion medium.

Then, 4.0 parts of t-butylperoxy pivalate, which is a polymerization initiator, were added to the polymerizable monomer composition, and then the latter was added to the above aqueous dispersion medium. Granulation was performed then for 3 minutes while maintaining 15000 revolutions/minute in the high-speed stirring device (granulating step). Thereafter, the stirrer in the high-speed stirring device was replaced with a propeller stirring blade, and polymerization was conducted for 8 hours with the temperature kept at 70° C., and while under stirring at 150 revolutions/minute. The temperature was raised then to 100° C., and heating was continued for 4 hours, to remove thereby solvent and unreacted monomers (polymerization process). The obtained resin particle dispersion solution is resin particle dispersion solution 1.

Part of the dispersion solution was extracted and was cooled down to a temperature of 20° C. while under continued stirring. A measurement of the polymerization conversion of the resin particles in the extracted dispersion yielded a result of 100.0 (mass %). The resin particles resulting from washing and drying of the extracted dispersion solution yielded resin particles 1. The obtained resin particles had a TgA (° C.) of 45° C. and a TmA (° C.) of 75° C.

<Production of Resin Particle Dispersion Solutions 2 to 13>

Resin particle dispersion solutions 2 to 13 were obtained in the same way as in the production method of resin particle dispersion solution 1, but herein the starting materials where changed as given in Table 3.

<Production of Resin Particle Dispersion Solution 14>

A reaction vessel provided with a reflux condenser, a stirrer and a nitrogen inlet tube was charged with the materials below, in a nitrogen atmosphere.

| | |
|---|---|
| Toluene | 100.0 parts |
| Styrene | 75.0 parts |
| n-butylacrylate | 25.0 parts |
| t-butylperoxy pivalate | 3.0 parts |

The interior of the vessel was stirred at 200 revolutions per minute, and was heated at 70° C., with stirring for 10 hours. The reaction vessel was further heated at 100° C. to distill off the solvent for 6 hours, and yield binder resin 1. Then, the following components:

| | |
|---|---|
| Binder resin 1 | 70.0 parts |
| Block polymer 1 | 30.0 parts |
| Release agent: paraffin wax (HNP-9: by Nippon Seiro, melting point 75° C.) | 7.0 parts |
| Pigment blue 15:3 | 6.0 parts |
| Aluminum salicylate compound (BONTRON E-88: by Orient Chemical Industries) | 1.0 part |
| Ethyl acetate | 200.0 parts |

were mixed and dispersed for 10 hours in a ball mill; the obtained dispersion solution was charged into 2000 parts of deionized water comprising 3.5 mass % of tricalcium phosphate, and granulation was performed for 10 minutes in a high-speed stirring device TK-homomixer, with the rotational speed thereof set to 15000 revolutions/minute. Thereafter, the solvent was removed through holding for 4 hours at 75° C. in a water bath, while under stirring at 150 revolutions/minute using a general purpose stirrer (three-one motor), to yield resin particle dispersion solution 14.

Part of the dispersion solution was extracted and was cooled down to a temperature of 20° C. while under continued stirring. A measurement of the solvent removal rate of the resin particles in the extracted dispersion solution yielded a result of 100.0 (mass %). The extracted dispersion solution was washed and dried; the obtained resin particles had a TgA (° C.) of 50° C. and a TmA (° C.) of 75° C.

<Production of Resin Particle Dispersion Solution 15>

(Preparation of a Binder Resin Dispersion Solution)

| | |
|---|---|
| Styrene | 75.0 parts |
| n-butylacrylate | 25.0 parts |

A mixture of the above constituents was dispersed and emulsified in an aqueous medium, and was mixed slowly for 10 minutes. The aqueous medium used herein resulted from adding 1.5 parts of a nonionic surfactant (Nonipol 400, by Sanyo Chemical Industries) and 2.2 parts of an anionic surfactant (Neogen SC, by Dai-ichi Kogyo Seiyaku) to 120.0 parts of deionized water. Then, 10.0 parts of deionized water having dissolved therein 1.5 parts of ammonium persulfate, as a polymerization initiator, were added to the mixture of the emulsion, under continued stirring. After nitrogen purging, the contents were heated up to a temperature of 70° C., under stirring, and emulsion polymerization was continued like that for 4 hours. Thereafter, the amount of deionized water was adjusted so as to yield a solids concentration of 20.0 mass %; a binder resin dispersion solution was thus obtained. The resin particles dispersed in the obtained binder resin dispersion solution had a volume-average particle diameter of 0.29 μm.

(Preparation of a Block Polymer Dispersion Solution)

| | |
|---|---|
| Block polymer 1: | 50.0 parts |
| Anionic surfactant (Neogen SC, by Dai-ichi Kogyo Seiyaku) | 7.0 parts |
| Deionized water | 200.0 parts |

The above constituents were heated at a temperature of 95° C. and dispersed in a homogenizer (Ultra-Turrax T50, by IKA), and were subjected thereafter to a dispersion treatment in a pressure-ejection homogenizer. Thereafter, the amount of deionized water was adjusted so as to yield a solids concentration of 20.0 mass %. A block polymer dispersion solution was thus obtained. The block polymer particles dispersed in the obtained block polymer dispersion solution had a volume-average particle diameter of 0.31 μm.

(Preparation of a Colorant Dispersion Solution)

| | |
|---|---|
| Cyan colorant (C. I. Pigment blue 15:3) | 20.0 parts |
| Anionic surfactant (Neogen SC, by Dai-ichi Kogyo Seiyaku) | 3.0 parts |
| Deionized water | 78.0 parts |

The above formulation components were mixed and were dispersed using a sand grinder mill. Thereafter, the amount of deionized water was adjusted so as to yield a solids concentration of 20.0 mass %. A colorant dispersion solution was thus obtained. The particle diameter distribution of the colorant dispersion solution was measured using a particle diameter measurement device (LA-700, by Horiba). The volume-average particle diameter of the colorant in the solution was 0.20 μm, and no coarse particles in excess of 1.00 μm were observed.

(Preparation of a Wax Dispersion Solution)

| | |
|---|---|
| Hydrocarbon wax (HNP-9: by Nippon Seiro, melting point 75° C.) | 50.0 parts |
| Anionic surfactant (Neogen SC, by Dai-ichi Kogyo Seiyaku) | 7.0 parts |
| Deionized water | 200.0 parts |

The above constituents were heated at a temperature of 95° C. and dispersed in a homogenizer (Ultra-Turrax T50, by IKA), and were subjected thereafter to a dispersion treatment in a pressure-ejection homogenizer. Thereafter, the amount of deionized water was adjusted so as to yield a solids concentration of 20.0 mass %. A wax dispersion solution was thus obtained. The wax particles dispersed in the obtained wax dispersion solution had a volume-average particle diameter of 0.50 μm.

(Preparation of a Charge Control Particle Dispersion Solution)

| | |
|---|---|
| Metal compound of dialkyl salicylic acid (Negative charge control agent, BONTRON E-84, by Orient Chemical Industries) | 5.0 parts |
| Anionic surfactant (Neogen SC, by Dai-ichi Kogyo Seiyaku) | 3.0 parts |
| Deionized water | 78.0 parts |

The above constituents were mixed and were dispersed using a sand grinder mill. Thereafter, the amount of deionized water was adjusted so as to yield a solids concentration of 5.0 mass %. A charge control particle dispersion solution was thus obtained.

(Preparation of a Mixed Solution)

| | |
|---|---|
| Binder resin dispersion solution | 70.0 parts |
| Block polymer dispersion solution | 30.0 parts |
| Colorant dispersion solution | 6.0 parts |
| Wax dispersion solution | 7.0 parts |

The above were charged into, and stirred in, a 1-liter separable flask equipped with a stirring device, a cooling tube and a thermometer. The pH of the resulting mixed solution was adjusted to pH=5.2 using 1 mol/L potassium hydroxide.

Then 120.0 parts of a 8.0 mass % aqueous solution of sodium chloride, as a flocculant, were dripped onto the mixed solution, with heating up to a temperature of 55° C., under stirring. Then 2.0 parts of the charge control particle dispersion solution were added upon reaching of that temperature. The temperature of 55° C. was held for 2 hours, after which formation of aggregated particles having an average particle diameter of 3.3 μm was confirmed upon observation using an optical microscope.

Thereafter, 3.0 parts of an anionic surfactant (Neogen SC, by Dai-ichi Kogyo Seiyaku) were further added, followed by heating up to a temperature of 95° C., under continued stirring. The temperature was then held for 4.5 hours. Part of the dispersion solution was extracted and was cooled down to a temperature of 20° C. while under continued stirring. The extracted dispersion solution was washed and dried; the obtained resin particles had a TgA (° C.) of 45° C. and a TmA (° C.) of 75° C.

The physical properties of the obtained resin particle dispersion solutions 1 to 15 are given in Table 3.

TABLE 3

| resin particle dispersion solution No. | production method | block polymer | resin particle properties: polymerization conversion or solvent removal rate (mass %) | glass transition point (TgA (° C.)) | onset temperature of endothermic peak (TmA (° C.)) |
|---|---|---|---|---|---|
| 1 | suspension polymerization | block polymer 1 | 100.0 | 45 | 75 |
| 2 | suspension polymerization | block polymer 2 | 100.0 | 44 | 60 |
| 3 | suspension polymerization | block polymer 3 | 100.0 | 43 | 58 |
| 4 | suspension polymerization | block polymer 4 | 100.0 | 45 | 80 |
| 5 | suspension polymerization | block polymer 5 | 100.0 | 43 | 62 |
| 6 | suspension polymerization | block polymer 6 | 100.0 | 43 | 75 |
| 7 | suspension polymerization | block polymer 7 | 100.0 | 45 | 75 |
| 8 | suspension polymerization | block polymer 8 | 100.0 | 44 | 85 |
| 9 | suspension polymerization | block polymer 9 | 100.0 | 45 | 71 |
| 10 | suspension polymerization | block polymer 10 | 100.0 | 43 | 75 |
| 11 | suspension polymerization | block polymer 11 | 100.0 | 45 | 69 |
| 12 | suspension polymerization | crystalline polyester 1 | 100.0 | 45 | 80 |
| 13 | suspension polymerization | crystalline polyester 2 | 100.0 | 45 | 80 |
| 14 | dissolution suspension | block polymer 1 | 100.0 | 50 | 75 |
| 15 | emulsion aggregation | block polymer 1 | 100.0 | 45 | 75 |

Examples 1 to 39

An annealing process as in Table 4 and FIGS. 5 to 9 was carried out using the resin particle dispersion solutions 1 to 11 and 14, while under continued stirring, and the dispersion solutions were cooled thereafter down to a temperature of 20° C. This was followed by washing and drying, to yield toner particles 1 to 39. The physical properties of the obtained toner particles 1 to 39 are given in Table 6.

Comparative Examples 1 to 10

Figure 5:
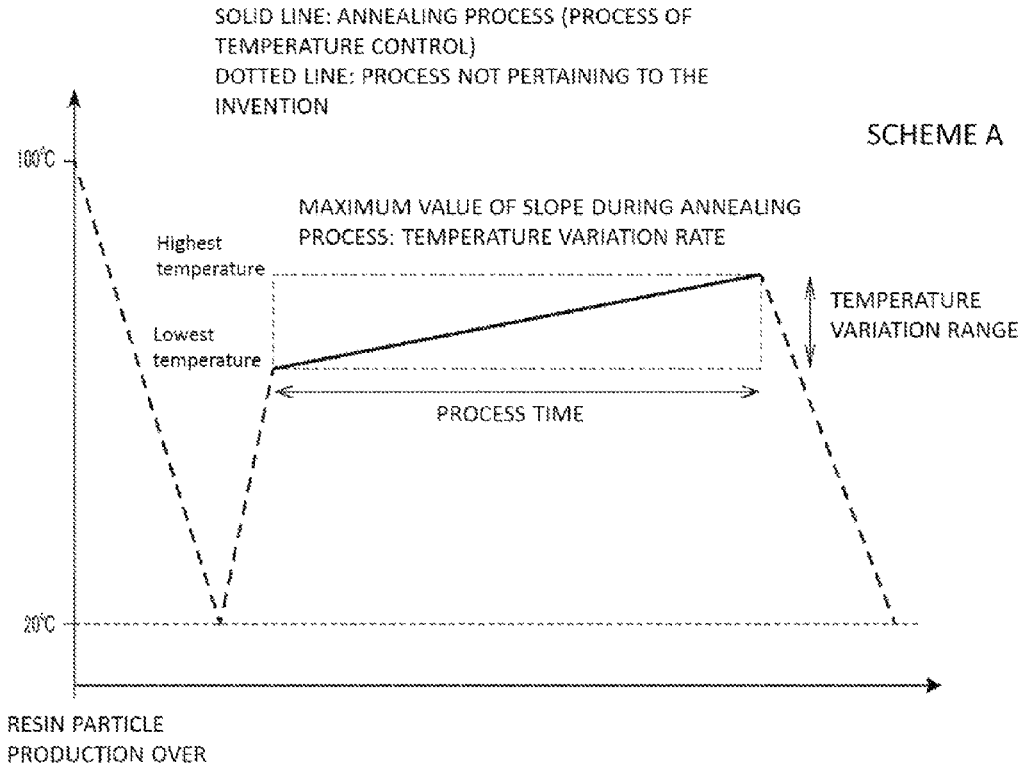
FIG. 5 is a diagram for explaining scheme A of an annealing process of the present invention.
Figure 6:
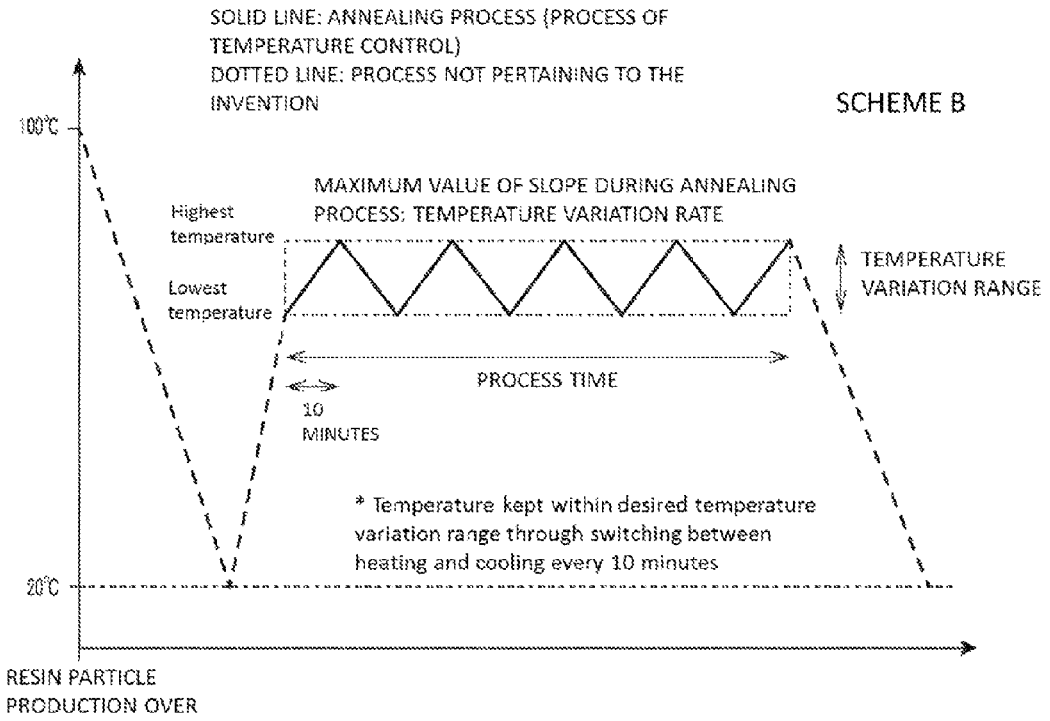
FIG. 6 is a diagram for explaining scheme B of an annealing process of the present invention.
Figure 7:
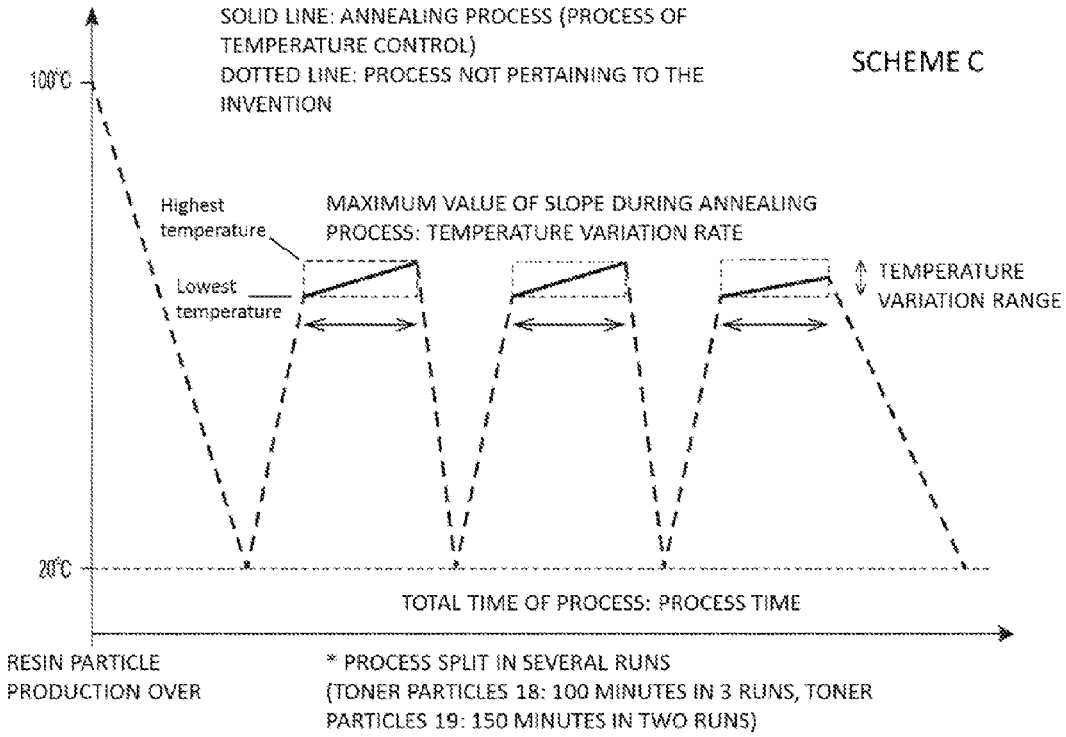
FIG. 7 is a diagram for explaining scheme C of an annealing process of the present invention.
Figure 8:
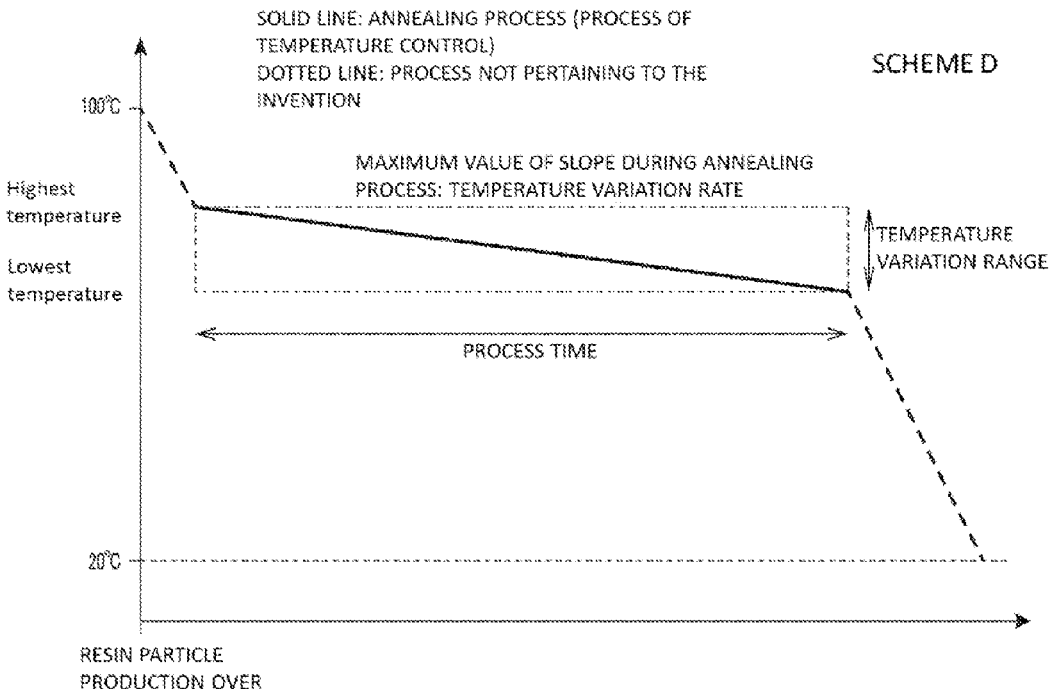
FIG. 8 is a diagram for explaining scheme D of an annealing process of the present invention.
Figure 9:
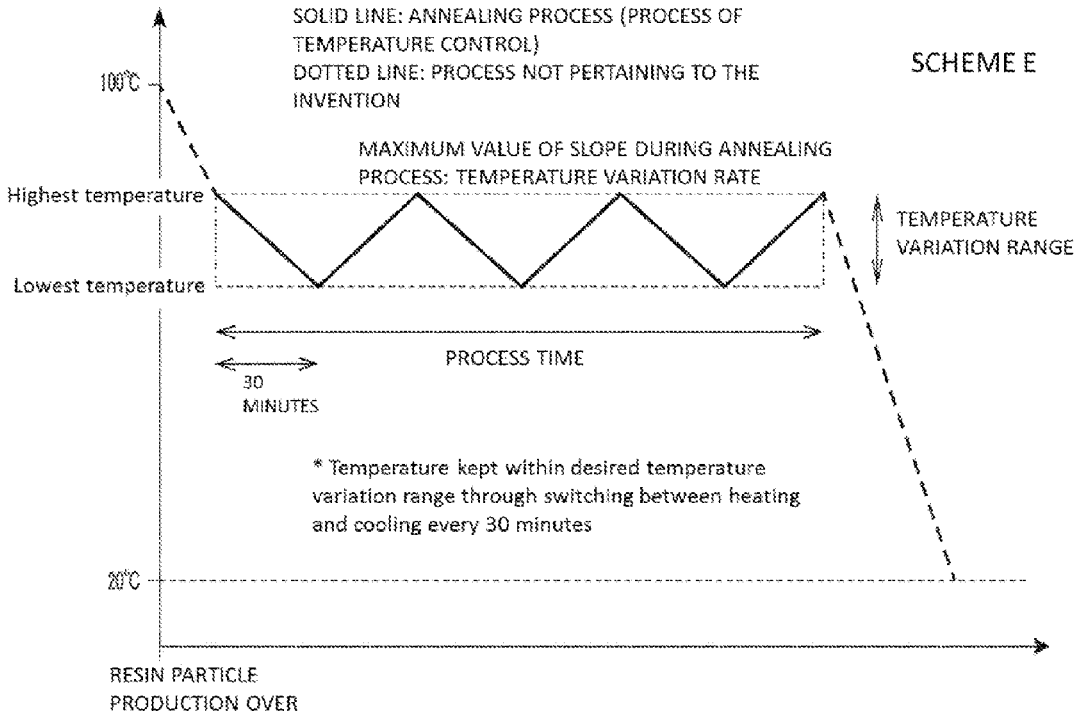
FIG. 9 is a diagram for explaining scheme E of an annealing process of the present invention.

An annealing process as in Table 5 and FIG. 5 was carried out using resin particle dispersion solutions 1, 12, 13 and 15, while under continued stirring, and the dispersion solutions were cooled thereafter down to a temperature of 20° C. This was followed by washing and drying, to yield toner particles 40 to 49.

The details of schemes A to E in the above annealing process are as explained for FIGS. 5 to 9.

Firstly, each resin particle dispersion solution was warmed up to 100° C. at a rate of 0.5° C./minute. Thereafter, in schemes A to C, the dispersion solution was cooled down to 20° C. at a rate of 0.5° C./minute, was further warmed, at a rate of 1.0° C./minute, up to an annealing start temperature, and the annealing process was then initiated. After the annealing process was over, the dispersion solution was cooled, at a rate of 0.5° C./minute, from the annealing process end temperature down to 20° C. In scheme C, the above process was split into a plurality of processes; however, cooling and heating between respective processes involved cooling at a rate of 0.5° C./minute down to 20° C., and warming at a rate of 1.0° C./minute up to the annealing start temperature.

In schemes D and E, the resin microparticles were warmed at a rate of 0.5° C./minute up to 100° C., and were cooled thereafter at a rate of 1.0° C./minute down to the annealing start temperature, whereupon the annealing process was initiated. After the annealing process was over, the resin microparticles were cooled, at a rate of 0.5° C./minute, from the annealing process end temperature down to 20° C.

In the procedure of a dry-type annealing process (Comparative example 10), unmodified toner particles in powder form were spread to a depth of about 1 cm on a metallic pad, and were stored at a prescribed temperature.

A water bath was used for a 1 L resin particle dispersion solution in all the instances of the above annealing process. However, any process volume and process device may be resorted to, so long as the annealing process according to the present invention can be carried out.

The physical properties of toner particles 40 to 49 are given in Table 6.

TABLE 4

| | | | annealing process conditions: highest temperature (° C.) | lowest temperature (° C.) | temperature variation range (° C.) | temperature variation rate (° C./min) | process time (min) | scheme |
|---|---|---|---|---|---|---|---|---|
| Example 1 | toner particle 1 | resin particle dispersion solution 1 | 55 | 54 | 1 | 0.00 | 300 | A |
| Example 2 | toner particle 2 | resin particle dispersion solution 14 | 55 | 54 | 1 | 0.00 | 300 | A |
| Example 3 | toner particle 3 | resin particle dispersion solution 1 | 50 | 49 | 1 | 0.00 | 300 | A |
| Example 4 | toner particle 4 | resin particle dispersion solution 1 | 47 | 46 | 1 | 0.00 | 300 | A |
| Example 5 | toner particle 5 | resin particle dispersion solution 1 | 47 | 47 | 0 | 0.00 | 60 | A |
| Example 6 | toner particle 6 | resin particle dispersion solution 1 | 65 | 64 | 1 | 0.00 | 300 | A |

TABLE 4-continued

| | | | annealing process conditions | | | | | |
|---|---|---|---|---|---|---|---|---|
| | | | highest temperature (° C.) | lowest temperature (° C.) | temperature variation range (° C.) | temperature variation rate (° C./min) | process time (min) | scheme |
| Example 7 | toner particle 7 | resin particle dispersion solution 1 | 75 | 73 | 2 | 0.00 | 300 | A |
| Example 8 | toner particle 8 | resin particle dispersion solution 1 | 75 | 73 | 2 | 0.00 | 1200 | A |
| Example 9 | toner particle 9 | resin particle dispersion solution 1 | 55 | 55 | 0 | 0.00 | 120 | A |
| Example 10 | toner particle 10 | resin particle dispersion solution 1 | 55 | 55 | 0 | 0.00 | 60 | A |
| Example 11 | toner particle 11 | resin particle dispersion solution 1 | 55 | 54 | 1 | 0.00 | 600 | A |
| Example 12 | toner particle 12 | resin particle dispersion solution 1 | 55 | 54 | 1 | 0.00 | 1200 | A |
| Example 13 | toner particle 13 | resin particle dispersion solution 1 | 60 | 45 | 15 | 0.05 | 300 | A |
| Example 14 | toner particle 14 | resin particle dispersion solution 1 | 65 | 50 | 15 | 0.05 | 300 | A |
| Example 15 | toner particle 15 | resin particle dispersion solution 1 | 63 | 45 | 18 | 0.10 | 300 | A |
| Example 16 | toner particle 16 | resin particle dispersion solution 1 | 57 | 55 | 2 | 0.20 | 300 | B |
| Example 17 | toner particle 17 | resin particle dispersion solution 1 | 57 | 52 | 5 | 0.35 | 300 | B |
| Example 18 | toner particle 18 | resin particle dispersion solution 1 | 55 | 55 | 0 | 0.00 | 100 × 3 | C |
| Example 19 | toner particle 19 | resin particle dispersion solution 1 | 55 | 55 | 0 | 0.00 | 150 × 2 | C |
| Example 20 | toner particle 20 | resin particle dispersion solution 1 | 63 | 45 | 18 | 0.06 | 300 | A |
| Example 21 | toner particle 21 | resin particle dispersion solution 1 | 55 | 54 | 1 | 0.00 | 300 | D |
| Example 22 | toner particle 22 | resin particle dispersion solution 1 | 45 | 45 | 0 | 0.00 | 300 | D |
| Example 23 | toner particle 23 | resin particle dispersion solution 1 | 65 | 64 | 1 | 0.00 | 300 | D |
| Example 24 | toner particle 24 | resin particle dispersion solution 1 | 75 | 73 | 2 | 0.00 | 300 | D |
| Example 25 | toner particle 25 | resin particle dispersion solution 1 | 65 | 50 | 15 | 0.05 | 300 | D |
| Example 26 | toner particle 26 | resin particle dispersion solution 1 | 55 | 46 | 9 | 0.30 | 300 | E |
| Example 27 | toner particle 27 | resin particle dispersion solution 2 | 48 | 48 | 0 | 0.00 | 300 | A |
| Example 28 | toner particle 28 | resin particle dispersion solution 2 | 60 | 59 | 1 | 0.00 | 300 | A |
| Example 29 | toner particle 29 | resin particle dispersion solution 2 | 47 | 45 | 2 | 0.00 | 300 | A |
| Example 30 | toner particle 30 | resin particle dispersion solution 2 | 60 | 60 | 0 | 0.00 | 300 | A |
| Example 31 | toner particle 31 | resin particle dispersion solution 3 | 50 | 49 | 1 | 0.00 | 300 | A |
| Example 32 | toner particle 32 | resin particle dispersion solution 4 | 55 | 55 | 0 | 0.00 | 300 | A |
| Example 33 | toner particle 33 | resin particle dispersion solution 5 | 45 | 45 | 0 | 0.00 | 300 | A |
| Example 34 | toner particle 34 | resin dispersion solution 6 | 55 | 54 | 1 | 0.00 | 300 | A |
| Example 35 | toner particle 35 | resin dispersion solution 7 | 55 | 54 | 1 | 0.00 | 300 | A |
| Example 36 | toner particle 36 | resin particle dispersion solution 8 | 55 | 54 | 1 | 0.00 | 300 | A |
| Example 37 | toner particle 37 | resin particle dispersion solution 9 | 55 | 54 | 1 | 0.00 | 300 | A |
| Example 38 | toner particle 38 | resin particle dispersion solution 10 | 55 | 54 | 1 | 0.00 | 300 | A |
| Example 39 | toner particle 39 | resin particle dispersion solution 11 | 55 | 54 | 1 | 0.00 | 300 | A |

TABLE 5

| | | | annealing process conditions | | | | | |
|---|---|---|---|---|---|---|---|---|
| | | | highest temperature (° C.) | lowest temperature (° C.) | temperature variation range (° C.) | temperature variation rate (° C./min) | process time (min) | scheme |
| comparative example 1 | toner particle 40 | resin particle dispersion solution 1 | no annealing | | | | | |
| comparative example 2 | toner particle 41 | resin particle dispersion solution 12 | 52 | 50 | 2 | 0.00 | 300 | A |
| comparative example 3 | toner particle 42 | resin particle dispersion solution 13 | 52 | 50 | 2 | 0.00 | 300 | A |
| comparative example 4 | toner particle 43 | resin particle dispersion solution 1 | 40 | 40 | 0 | 0.00 | 300 | A |
| comparative example 5 | toner particle 44 | resin particle dispersion solution 1 | 78 | 76 | 2 | 0.00 | 300 | A |
| comparative example 6 | toner particle 45 | resin particle dispersion solution 1 | 51 | 51 | 0 | 0.00 | 40 | A |
| comparative example 7 | toner particle 46 | resin particle dispersion solution 1 | 72 | 48 | 24 | 0.40 | 60 | A |
| comparative example 8 | toner particle 47 | resin particle dispersion solution 15 | 54 | 54 | 0 | 0.00 | 90 | A |
| comparative example 9 | toner particle 48 | resin particle dispersion solution 15 | 75 | 75 | 0 | 0.00 | 90 | A |
| comparative example 10 | toner particle 49 | dried resin particle dispersion solution 1 | 45 | 45 | 0 | 0.00 | 300 | dry |

TABLE 6

| | | | endothermic peak (toner particles) | |
|---|---|---|---|---|
| | | Tg of toner particles (° C.) | Tmp (° C.) | heat absorption amount ΔH (J/g) |
| example 1 | toner particle 1 | 51 | 80 | 17.8 |
| example 2 | toner particle 2 | 52 | 80 | 14.2 |
| example 3 | toner particle 3 | 51 | 80 | 17.5 |
| example 4 | toner particle 4 | 51 | 80 | 18.5 |
| example 5 | toner particle 5 | 48 | 65, 80 | 12.5 |
| example 6 | toner particle 6 | 50 | 80 | 19.0 |
| example 7 | toner particle 7 | 49 | 80 | 18.5 |
| example 8 | toner particle 8 | 49 | 80 | 20.0 |
| example 9 | toner particle 9 | 52 | 70, 80 | 16.9 |
| example 10 | toner particle 10 | 50 | 70, 80 | 16.7 |
| example 11 | toner particle 11 | 51 | 80 | 19.2 |
| example 12 | toner particle 12 | 51 | 80 | 20.1 |
| example 13 | toner particle 13 | 50 | 80 | 16.5 |
| example 14 | toner particle 14 | 49 | 80 | 15.9 |
| example 15 | toner particle 15 | 50 | 72, 80 | 15.8 |
| example 16 | toner particle 16 | 49 | 80 | 14.5 |
| example 17 | toner particle 17 | 50 | 80 | 18.8 |
| example 18 | toner particle 18 | 51 | 80 | 18.9 |
| example 19 | toner particle 19 | 51 | 80 | 19.7 |
| example 20 | toner particle 20 | 49 | 80 | 16.5 |
| example 21 | toner particle 21 | 53 | 80 | 14.2 |
| example 22 | toner particle 22 | 52 | 80 | 15.2 |
| example 23 | toner particle 23 | 51 | 80 | 16.0 |
| example 24 | toner particle 24 | 49 | 80 | 13.5 |
| example 25 | toner particle 25 | 50 | 80 | 14.2 |
| example 26 | toner particle 26 | 50 | 80 | 13.5 |
| example 27 | toner particle 27 | 50 | 57, 65 | 10.2 |
| example 28 | toner particle 28 | 50 | 65 | 9.9 |
| example 29 | toner particle 29 | 51 | 57, 65 | 6.7 |
| example 30 | toner particle 30 | 48 | 65 | 6.2 |
| example 31 | toner particle 31 | 48 | 61 | 10.2 |
| example 32 | toner particle 32 | 51 | 85 | 23.2 |
| example 33 | toner particle 33 | 49 | 71 | 14.2 |
| example 34 | toner particle 34 | 48 | 80 | 18.9 |
| example 35 | toner particle 35 | 48 | 80 | 12.7 |
| example 36 | toner particle 36 | 49 | 93 | 24.1 |
| example 37 | toner particle 37 | 49 | 74 | 9.7 |
| example 38 | toner particle 38 | 48 | 80 | 25.8 |
| example 39 | toner particle 39 | 50 | 72 | 9.2 |

TABLE 6-continued

| | | | endothermic peak (toner particles) | |
|---|---|---|---|---|
| | | Tg of toner particles (° C.) | Tmp (° C.) | heat absorption amount ΔH (J/g) |
| comparative example 1 | toner particle 40 | 45 | 80 | 9.2 |
| comparative example 2 | toner particle 41 | 45 | 84 | 26.8 |
| comparative example 3 | toner particle 42 | 47 | 84 | 24.9 |
| comparative example 4 | toner particle 43 | 46 | 80 | 9.4 |
| comparative example 5 | toner particle 44 | 44 | 80 | 10.1 |
| comparative example 6 | toner particle 45 | 45 | 80 | 9.2 |
| comparative example 7 | toner particle 46 | 49 | 80 | 9.9 |
| comparative example 8 | toner particle 47 | 50 | 80 | 18.2 |
| comparative example 9 | toner particle 48 | 50 | 80 | 14.3 |
| comparative example 10 | toner particle 49 | 47 | 80 | 3.2 |

Where a plurality of endothermic peaks (toner particles) Tmp (° C.) was observed the corresponding plurality of peak temperatures is given in Table 6. In such instances, the heat absorption amount ΔH in the table denotes a total value that includes the plurality of endothermic peaks. If an endothermic peak derived from the block polymer overlapped with the endothermic peak derived from the release agent, there was used a value arrived at by subtracting the heat absorption amount derived from the release agent. The heat absorption amount derived from the release agent was calculated on the basis of the heat absorption amount of the release agent alone, and the amount of release agent that was charged into the toner.

Production of Various Toners

The toner particles obtained in Examples 1 to 39 and Comparative examples 1 to 10 were classified, and, thereafter, 100.0 parts of the respective toner particles were weighed, and 1.0 part of silica fine particles, having a number-average particle diameter of 40 nm of primary particles, was added to the toner particles, and the whole was mixed using a Henschel mixer (by Mitsui Miike Machinery), to yield a respective toner.

Evaluation

The performance of the obtained toners was evaluated in accordance with the methods below. The evaluation results are given in Table 7.

[Heat Resistance]

Herein, 5 g of each toner was sampled in a 50 mL plastic cup and was left to stand for 3 days at a temperature of 50° C. and humidity of 10% RH. The presence or absence of aggregates was evaluated as follows.

(Evaluation Criteria)

A: No aggregates occur.

B: Slight occurrence of aggregates, which break up when lightly shaken.

C: Slight occurrence of aggregates, which break up under light finger pressure.

D: Aggregates occur and do not collapse even when lightly pressed with fingers.

E: Complete aggregation.

[Developing Performance]

(Development Stripes)

Evaluation was performed by modifying a commercially available color laser printer (HP Color LaserJet 3525dn, by HP), in such a way that the printer operated with only one process cartridge, of one color, fitted thereto. The toner held in the cyan cartridge installed in the color laser printer was removed, the interior of the cartridge was cleaned by air blowing and, thereafter, the cartridge was filled instead with the toner to be evaluated (300 g). Then, 500 copies of a chart having a print coverage of 2% were continuously printed using Office planner by Canon (64 g/m$^2$) as image-receiving paper, under normal temperature and normal humidity conditions (23° C., 60% RH). After printing, a halftone image was outputted, and the presence or absence of image stripes on the halftone image, as well as the presence or absence of stripes on the developing roller, were observed, to evaluate developing performance as follows.

(Evaluation Criteria)

A: Absence of visible vertical streaks, in the paper-feed direction, resembling development stripes, on either the developing roller or on the image, in the halftone area.

B: One to four fine stripes, in the peripheral direction, at both ends of the developing roller, but absence of visible vertical streaks, in the paper-feed direction, resembling development stripes, on the image, in the halftone area.

C: One to four fine stripes, in the peripheral direction, at both ends of the developing roller, several fine development stripes visible also on image, in the halftone area.

D: Five or more stripes, in the peripheral direction, at both ends of the developing roller, or five or more fine development stripes visible on the image, in the halftone area.

E: Multiple noticeable development stripes, on the developing roller and on the image, in the halftone area.

(Reflection Density)

A solid image was further outputted and was measured for relative reflection density with respect to a printout image at a white background area, with original density 0.00, using a Macbeth densitometer (by Macbeth, with SPI filter), which is a reflection densitometer. The evaluation criteria were as given below. A larger value of reflection density signifies better developing performance.

(Evaluation Criteria)

A: Reflection density of 1.40 or higher.

B: Reflection density from 1.30 to less than 1.40.

C: Reflection density from 1.25 to less than 1.30.

D: Reflection density from 1.20 to less than 1.25.

E: Reflection density lower than 1.20.

[Temporal Change Characteristic]

The above measurement of reflection density was carried out using toner having been left to stand for 30 days in an environment at a temperature of 45° C./ and 10% RH, to evaluate the characteristic of change of developing performance over time. The evaluation criteria were as follows.

(Evaluation Criteria)

A: Reflection density of 1.40 or higher.

B: Reflection density from 1.30 to less than 1.40.

C: Reflection density from 1.25 to less than 1.30.

D: Reflection density from 1.20 to less than 1.25.

E: Reflection density lower than 1.20.

[Low-Temperature Fixability]

A color laser printer (HP Color LaserJet 3525dn, by HP) with the fixing unit removed therefrom was prepared, the toner was removed from the cyan cartridge, and the cartridge was filled instead with the toner to be evaluated. Next, an unfixed toner image (0.6 mg/cm$^2$), 2.0 cm long and 15.0 cm wide, was formed, over a portion of 1.0 cm from the top edge in the paper feed direction, using the filled toner, on image-receiving paper (Office planner, by Canon, 64 g/m$^2$). The removed fixing unit was then modified in such a manner that the fixation temperature and process speed thereof could be regulated, and a fixing test of the unfixed image was carried out using the modified fixing unit.

Firstly, the process speed was set to 200 mm/s, and fixing linear pressure was set to 20.0 kgf, under a normal-temperature, normal-humidity environment (23° C., 60% RH), and the unfixed image was fixed at respective temperatures, while sequentially raising the set temperature in increments of 5° C. from an initial temperature of 100° C.

The evaluation criteria of low-temperature fixability were as given below. Herein, the low-temperature-fixing onset temperature denotes a lower-limit temperature at which there is observed no cold offset phenomenon (phenomenon where part of the toner adheres to the fixing unit).

A: Low-temperature-fixing onset temperature up to 115° C.

B: Low-temperature-fixing onset temperature of 120° C. or 125° C.

C: Low-temperature-fixing onset temperature of 130° C. or 135° C.

D: Low-temperature-fixing onset temperature of 140° C. or 145° C.

E: Low-temperature-fixing onset temperature of 150° C. or higher.

TABLE 7

| | | | developing performance | | | | | | | low-temperature fixability |
|---|---|---|---|---|---|---|---|---|---|---|
| | | | development stripes | | | | temporal change | | | low-temperature-fixing onset temperature |
| | | heat resistance | rank | number of stripes on developing roller | reflection density rank | reflection density density | characteristic reflection density after temporal change rank | characteristic reflection density after temporal change density | rank | (° C.) |
| example 1 | toner particles 1 | A | A | 0 | A | 1.45 | A | 1.46 | A | 115 |
| example 2 | toner particles 2 | A | A | 0 | B | 1.39 | B | 1.39 | B | 120 |
| example 3 | toner particles 3 | A | A | 0 | A | 1.45 | A | 1.45 | A | 115 |
| example 4 | toner particles 4 | A | A | 0 | A | 1.42 | A | 1.43 | A | 115 |
| example 5 | toner particles 5 | C | B | 3 | A | 1.45 | C | 1.29 | A | 110 |
| example 6 | toner particles 6 | A | B | 1 | B | 1.32 | B | 1.33 | A | 115 |
| example 7 | toner particles 7 | B | B | 1 | B | 1.33 | B | 1.33 | A | 115 |
| example 8 | toner particles 8 | B | B | 1 | B | 1.31 | B | 1.31 | B | 120 |
| example 9 | toner particles 9 | A | A | 0 | A | 1.42 | A | 1.45 | A | 115 |
| example 10 | toner particles 10 | B | B | 1 | A | 1.43 | B | 1.39 | A | 115 |
| example 11 | toner particles 11 | A | A | 0 | A | 1.43 | A | 1.45 | A | 115 |
| example 12 | toner particles 12 | A | A | 0 | A | 1.43 | A | 1.45 | A | 115 |
| example 13 | toner particles 13 | A | A | 0 | A | 1.45 | A | 1.45 | A | 115 |
| example 14 | toner particles 14 | B | B | 2 | B | 1.39 | B | 1.37 | A | 115 |
| example 15 | toner particles 15 | B | B | 2 | B | 1.39 | B | 1.33 | A | 115 |
| example 16 | toner particles 16 | A | A | 0 | A | 1.45 | A | 1.43 | A | 115 |
| example 17 | toner particles 17 | B | C | 4 | B | 1.31 | C | 1.25 | A | 115 |
| example 18 | toner particles 18 | A | B | 4 | C | 1.27 | C | 1.26 | A | 115 |
| example 19 | toner particles 19 | A | B | 3 | B | 1.30 | C | 1.29 | A | 115 |
| example 20 | toner particles 20 | C | B | 1 | A | 1.45 | B | 1.35 | A | 115 |
| example 21 | toner particles 21 | A | A | 0 | A | 1.45 | A | 1.45 | A | 115 |
| example 22 | toner particles 22 | A | A | 0 | A | 1.44 | A | 1.45 | A | 115 |
| example 23 | toner particles 23 | A | A | 0 | A | 1.45 | A | 1.40 | A | 115 |
| example 24 | toner particles 24 | B | B | 1 | A | 1.42 | C | 1.28 | B | 120 |
| example 25 | toner particles 25 | A | A | 0 | A | 1.45 | A | 1.45 | A | 115 |
| example 26 | toner particles 26 | A | B | 1 | B | 1.32 | B | 1.31 | A | 115 |
| example 27 | toner particles 27 | B | A | 0 | A | 1.45 | A | 1.43 | A | 110 |
| example 28 | toner particles 28 | B | C | 2 | A | 1.43 | B | 1.35 | A | 115 |
| example 29 | toner particles 29 | A | A | 0 | A | 1.45 | A | 1.43 | A | 110 |
| example 30 | toner particles 30 | C | C | 4 | A | 1.44 | B | 1.30 | A | 110 |
| example 31 | toner particles 31 | C | C | 1 | A | 1.40 | B | 1.39 | A | 110 |
| example 32 | toner particles 32 | A | A | 0 | A | 1.40 | A | 1.41 | B | 125 |
| example 33 | toner particles 33 | C | B | 1 | A | 1.42 | A | 1.41 | A | 110 |
| example 34 | toner particles 34 | C | B | 3 | A | 1.45 | C | 1.29 | B | 125 |
| example 35 | toner particles 35 | C | C | 4 | A | 1.43 | C | 1.25 | B | 125 |
| example 36 | toner particles 36 | C | B | 1 | B | 1.31 | C | 1.28 | B | 125 |
| example 37 | toner particles 37 | C | A | 0 | A | 1.45 | A | 1.43 | B | 125 |
| example 38 | toner particles 38 | C | C | 4 | C | 1.28 | C | 1.25 | C | 130 |
| example 39 | toner particles 39 | B | A | 0 | A | 1.45 | A | 1.43 | C | 130 |
| comparative example 1 | toner particles 40 | E | E | 7 | B | 1.38 | E | 1.00 | A | 115 |
| comparative example 2 | toner particles 41 | E | C | 2 | E | 1.12 | E | 1.01 | C | 135 |
| comparative example 3 | toner particles 42 | D | B | 1 | E | 1.18 | E | 1.00 | D | 145 |
| comparative example 4 | toner particles 43 | E | D | 6 | B | 1.39 | E | 1.15 | A | 115 |
| comparative example 5 | toner particles 44 | E | C | 4 | E | 1.17 | E | 1.17 | A | 115 |
| comparative example 6 | toner particles 45 | E | E | 7 | B | 1.32 | E | 1.00 | A | 115 |
| comparative example 7 | toner particles 46 | D | C | 2 | B | 1.32 | E | 1.12 | A | 115 |
| comparative example 8 | toner particles 47 | A | C | 4 | A | 1.43 | B | 1.39 | D | 140 |
| comparative example 9 | toner particles 48 | A | E | 8 | E | 1.12 | E | 1.10 | D | 140 |
| comparative example 10 | toner particles 49 | E | E | 8 | E | 0.92 | E | 1.02 | A | 115 |

The present invention succeeds in providing a production method whereby a toner is obtained that can be fixed at low energy, has sufficient heat-resistant storability, and exhibits little changes in performance on account of storage at high temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-78043, filed Apr. 3, 2013 which is hereby incorporated by reference herein in its entirety.

What is claimed is:

1. A method for producing toner particles, comprising:

a process (A) of obtaining resin particles in accordance with method i) or ii) below i) adding, to an aqueous medium, a polymerizable monomer composition that contains a polymerizable monomer, a colorant and a block polymer, obtaining a granulated particles by performing granulation of the polymerizable monomer composition, and polymerizing the polymerizable monomer contained in the granulated particles, to thereby produce resin particles;

ii) preparing a resin solution by dissolving or dispersing a binder resin, a colorant and a block polymer in an organic solvent, adding the resin solution to an aqueous medium, performing granulation of the resin solution, and removing the organic solvent contained in the granulated particles, to thereby produce resin particles; and a process (B) of holding the temperature of the aqueous medium in which the resin particles obtained in the process (A) are dispersed, for 60 minutes or more, between a glass transition point TgA (° C.) of the resin particles and an onset temperature TmA (° C.) of an endothermic peak derived from the block polymer in the resin particles, in such a manner that a temperature fluctuation rate is not greater than 0.35° C./minute, and a temperature fluctuation range is not greater than 20° C., wherein each of the toner particles contains:

a) a binder resin having a styrene-acrylic resin as a main component;

b) a colorant; and c) a block polymer; and the block polymer contains polyester segments and vinyl polymer segments, and has an endothermic peak in a measurement using a differential scanning calorimeter.

2. The method for producing toner particles according to claim 1, wherein the temperature of the aqueous medium in the process (B) is set to a temperature range from the glass transition point TgA (° C.) of the resin particles up to a temperature TcA (° C.) at which generation of heat associated with cold crystallization of the block polymer is over.

3. The method for producing toner particles according to claim 1, wherein the polyester segments of the block polymer are made up of a dicarboxylic acid represented by Formula (1) below and a diol represented by Formula (2) below:

$$HOOC—(CH_2)_m—COOH \qquad \text{Formula (1)}$$

(in the formula, m represents an integer from 6 to 14), $$HO—(CH_2)_m—OH \qquad \text{Formula (2)}$$

(in the formula, n represents an integer from 6 to 16).

4. The method for producing toner particles according to claim 1, wherein a glass transition point TgB (° C.) of the vinyl polymer segments of the block polymer is equal to or higher than TmA (° C.).

5. The method for producing toner particles according to claim 1, wherein a mass ratio of the polyester segments and the vinyl polymer segments in the block polymer is 30:70 to 70:30.

* * * * *